US010310397B2

(12) United States Patent
Sano et al.

(10) Patent No.: US 10,310,397 B2
(45) Date of Patent: Jun. 4, 2019

(54) TONER

(71) Applicant: CANON KABUSHIKI KAISHA, Tokyo (JP)

(72) Inventors: Tomohisa Sano, Mishima (JP); Yusuke Hasegawa, Suntou-gun (JP); Yoshitaka Suzumura, Mishima (JP); Yuujirou Nagashima, Susono (JP); Kozue Uratani, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/052,152

(22) Filed: Feb. 24, 2016

(65) Prior Publication Data

US 2016/0266509 A1 Sep. 15, 2016

(30) Foreign Application Priority Data

Mar. 9, 2015 (JP) ..... 2015-046250

(51) Int. Cl.
*G03G 9/08* (2006.01)
*G03G 9/087* (2006.01)

(52) U.S. Cl.
CPC ..... *G03G 9/08711* (2013.01); *G03G 9/0821* (2013.01)

(58) Field of Classification Search
CPC ..... G03G 9/08711; G03G 9/0821
See application file for complete search history.

(56) References Cited

U.S. PATENT DOCUMENTS 5,679,490 A * 10/1997 Yachi ..... G03G 9/0806 430/108.4
7,923,190 B2 4/2011 Magome et al.
8,778,585 B2 7/2014 Matsui et al.
9,029,055 B2 5/2015 Aoki et al.
9,097,997 B2 8/2015 Nomura et al.
9,244,371 B2 1/2016 Suzumura et al.
2011/0217646 A1* 9/2011 Shirai ..... C08G 63/16 430/109.4
2011/0281214 A1 11/2011 Kuroyama
2014/0140731 A1 5/2014 Hozumi et al.
2014/0335449 A1 11/2014 Uratani et al.
2014/0370431 A1 12/2014 Hiroko et al.
(Continued)

FOREIGN PATENT DOCUMENTS

JP 2009-063969 3/2009
JP 2011-237801 A 11/2011
JP 2013-15673 A 1/2013
(Continued)

*Primary Examiner* — Thorl Chea
(74) *Attorney, Agent, or Firm* — Venable LLP

(57) ABSTRACT

The toner has a toner particle that contains a binder resin, a colorant, a release agent, and a crystalline polyester, wherein the release agent contains an ester wax, and the peak top temperature of the maximum endothermic peak of the ester wax as measured with a differential scanning calorimeter is from 65° C. to 85° C., the ester wax satisfies specific conditions and the crystalline polyester satisfies specific conditions, the toner contains from 3.0 parts by mass to 20.0 parts by mass of the crystalline polyester per 100 parts by mass of the binder resin, and the mass ratio of the ester wax to crystalline polyester is from 25/75 to 75/25.

8 Claims, 1 Drawing Sheet

(56) References Cited

U.S. PATENT DOCUMENTS

2015/0064617 A1 3/2015 Magome et al.

FOREIGN PATENT DOCUMENTS

| | | | |
|---|---|---|---|
| JP | 2013-137420 | A | 7/2013 |
| JP | 2014-157223 | A | 8/2014 |
| JP | 2014-202932 | A | 10/2014 |
| JP | 2015-14644 | A | 1/2015 |

* cited by examiner

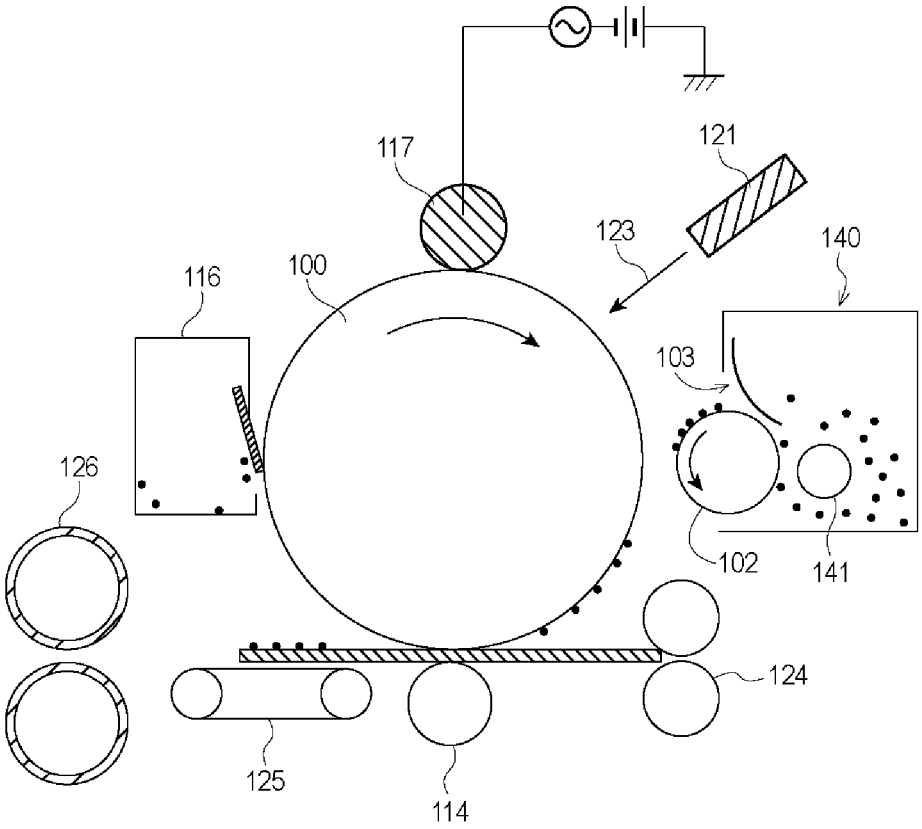
117
121
123
140
116
100
103
126
102
141
124
125
114

TONER

BACKGROUND OF THE INVENTION

Field of the Invention

The present invention relates to a toner that is used in recording methods that utilize, for example, an electrophotographic method.

Description of the Related Art

Image-forming apparatuses that use the electrophotographic method include, for example, copiers and printers. These printers and copiers are undergoing a conversion from analog to digital, and there is demand for an image quality that provides an excellent latent image reproducibility and a high resolution while at the same time being stable even during long-term use. In addition, there is demand for toner with an excellent fixing performance as an energy-saving countermeasure, and, for example, improvements to the binder resin and improvements to the wax are being carried out in order to improve the fixing performance.

Focusing here on the wax, it is generally known that the viscosity during melting is reduced and the fixing performance is improved through the use of a large amount of wax. On the other hand, the durability and storability are easily degraded when large amounts of wax are used, and adjusting the balance between the fixing performance and the durability/storability has heretofore been used to enable these characteristics to co-exist.

On the other hand, art in which the fixing performance and developing performance are balanced using crystalline polyester is disclosed in Japanese Patent Application Laid-open No. 2013-137420, Japanese Patent Application Laid-open No. 2013-15673, and Japanese Patent Application Laid-open No. 2011-237801.

SUMMARY OF THE INVENTION

However, a new issue, i.e., development streaks that are generated during low-temperature durability testing, has been prone to occur with toner for which the fixing performance has been improved through adjustments to the wax, and improvements with regard to the development streaks are thus required. Moreover, toner that contains crystalline polyester as cited above is also unsatisfactory with regard to development streaks accompanying low-temperature embrittlement, and improvements are required here.

While the concern is development streaks at low temperatures, the present inventors considered the problem to be their generation as follows and focused on this.

When a toner is exposed to low temperatures, the binder resin in the toner is cooled and undergoes embrittlement. When, for example, a printer is put into long-term use under such circumstances, cracking and chipping occur in portions of the toner and the detached portions undergo melt-adhesion to the developing blade and developing sleeve, and their presence is then seen in the formation of streaks in the image.

The present invention solves the problem indicated above. Specifically, a toner is provided that exhibits an excellent fixing performance and that provides a suppression of the generation of development streaks even during long-term use.

That is, the present invention is a toner that has a toner particle that contains a binder resin, a colorant, a release agent, and a crystalline polyester, wherein the release agent contains an ester wax; the ester wax has the peak top temperature of the maximum endothermic peak of at least 65° C. and not more than 85° C., in measurement of the ester wax with a differential scanning calorimeter; the ester wax satisfies the following condition (i) or (ii):

(i) the ester wax contains an ester compound, a partial structure derived from the alcohol component of the ester compound has a partial structure represented by the following formula (1), and the content of the ester compound based on the ester wax is at least 90% by mass, (ii) the ester wax contains an ester compound, a partial structure derived from the carboxylic acid component of the ester compound has a partial structure represented by the following formula (2), and the content of the ester compound based on the ester wax is at least 90% by mass;

the crystalline polyester satisfies the following condition (iii) or (iv):

(iii) the crystalline polyester has a partial structure represented by the following formula (3), and the content of the partial structure represented by formula (3) is at least 90 mol % based on the total number of moles of partial structures derived from the diol component in the crystalline polyester, (iv) the crystalline polyester has a partial structure represented by the following formula (4), and the content of the partial structure represented by formula (4) is at least 90 mol % based on the total number of moles of partial structures derived from the dicarboxylic acid component in the crystalline polyester;

the toner contains at least 3.0 parts by mass and not more than 20.0 parts by mass of the crystalline polyester per 100 parts by mass of the binder resin; and the mass ratio of the ester wax to crystalline polyester (ester wax/crystalline polyester) is at least 25/75 and not more than 75/25.

$$-O-C_xH_{2x}-O- \text{ or } C_xH_{2x+1}-O- \quad (1)$$

(In formula (1), x represents an integer from 6 to 12.)

$$-\overset{O}{\overset{\|}{C}}-C_yH_{2y}-\overset{O}{\overset{\|}{C}}- \text{ or } C_yH_{2y+1}-\overset{O}{\overset{\|}{C}}- \quad (2)$$

(In formula (2), y represents an integer from 4 to 10.)

$$-O-C_xH_{2x}-O- \quad (3)$$

(In formula (3), x represents an integer from 6 to 12.)

$$-\overset{O}{\overset{\|}{C}}-C_yH_{2y}-\overset{O}{\overset{\|}{C}}- \quad (4)$$

(In formula (4), y represents an integer from 4 to 10.)

The present invention can provide a toner that exhibits an excellent fixing performance and that provides a suppression of the generation of development streaks even during long-term use.

Further features of the present invention will become apparent from the following description of exemplary embodiments (with reference to the attached drawings).

BRIEF DESCRIPTION OF THE DRAWINGS

FIG. 1 is a schematic cross-sectional diagram that shows an example of an image-forming apparatus.

DESCRIPTION OF THE EMBODIMENTS

The toner of the present invention is a toner that has a toner particle that contains a binder resin, a colorant, a release agent, and a crystalline polyester, wherein the release agent contains an ester wax. The toner of the present invention has the following characteristic features.

The ester wax has the peak top temperature of the maximum endothermic peak of at least 65° C. and not more than 85° C., in measurement of the ester wax with a differential scanning calorimeter.

The ester wax satisfies the following condition (i) or (ii):

(i) the ester wax contains an ester compound, a partial structure derived from the alcohol component of the ester compound has a partial structure represented by the following formula (1), and the content of the ester compound based on the ester wax is at least 90% by mass, (ii) the ester wax contains an ester compound, a partial structure derived from the carboxylic acid component of the ester compound has a partial structure represented by the following formula (2), and the content of the ester compound based on the ester wax is at least 90% by mass.

The crystalline polyester satisfies the following condition (iii) or (iv):

(iii) the crystalline polyester has a partial structure represented by the following formula (3), and the content of the partial structure represented by formula (3) is at least 90 mol % based on the total number of moles of partial structures derived from the diol component in the crystalline polyester, (iv) the crystalline polyester has a partial structure represented by the following formula (4), and the content of the partial structure represented by formula (4) is at least 90 mol % based on the total number of moles of partial structures derived from the dicarboxylic acid component in the crystalline polyester.

The toner contains at least 3.0 parts by mass and not more than 20.0 parts by mass of the crystalline polyester per 100 parts by mass of the binder resin.

The mass ratio of the ester wax to crystalline polyester (ester wax/crystalline polyester) is at least 25/75 and not more than 75/25.

$$-O-C_xH_{2x}-O- \text{ or } C_xH_{2x+1}-O- \quad (1)$$

(In formula (1), x represents an integer from 6 to 12.)

$$-\overset{O}{\overset{\|}{C}}-C_yH_{2y}-\overset{O}{\overset{\|}{C}}- \text{ or } C_yH_{2y+1}-\overset{O}{\overset{\|}{C}}- \quad (2)$$

(In formula (2), y represents an integer from 4 to 10.)

$$-O-C_xH_{2x}-O- \quad (3)$$

(In formula (3), x represents an integer from 6 to 12.)

$$-\overset{O}{\overset{\|}{C}}-C_yH_{2y}-\overset{O}{\overset{\|}{C}}- \quad (4)$$

(In formula (4), y represents an integer from 4 to 10.)

The present inventors carried out intensive investigations and as a result discovered that, for a specific content of the crystalline polyester, microdispersion and crystallization of the crystalline polyester within the toner can be promoted by combining a specific crystalline polyester and a specific ester wax at a specific blending ratio. It was also discovered that a state that simultaneously achieves microdispersion and crystallization can provide significant improvements not only in the fixing performance, but also with regard to the generation of development streaks during long-term use. The present invention was achieved based on these discoveries.

The development streaks are considered first. The present inventors carried out investigations focusing on the generation of development streaks by the following mechanism.

When an apparatus that has a developing blade and a developing sleeve is considered, a mechanism is present in which the toner between the blade and sleeve is charged by being rubbed. At this point, cracking and chipping can be produced in portions of the toner, and these toner fragments can then show up as streaks on the image by melt-adhering to the developing sleeve.

Focusing on this cracking and chipping phenomenon, the major component of a toner is constituted of a binder resin. Polymers are known to generally undergo embrittlement at low temperatures. While the degree of the embrittlement depends on the type of binder resin, low-temperature embrittlement is facilitated when a material with a low molecular weight or a low melting point is added in order, for example, to raise the fixing performance of the toner, and as a consequence the fixing performance and low-temperature embrittlement frequently assume a trade-off relationship with each other.

This is also true for crystalline polyesters: when a crystalline polyester is simply added, the trend has been for the fixing performance to increase while the generation of development streaks worsens.

However, through the investigations done by the present inventors, it was discovered that—based on two points, i.e., bringing about the microdispersion of the crystalline polyester in the toner and promoting crystallization of the crystalline polyester—not only is the generation of low-temperature embrittlement avoided, but in fact the toughness (the degree of resistance to brittle fracture) of the binder resin is increased. This is thought to occur because the crystallized crystalline polyester is hard and, due to its function as a filler for the binder resin, its microdispersion within the binder resin results in a hardening of the toner as a whole.

The thinking of the present inventors with respect to the microdispersion and crystallization of crystalline polyester is described in the following. Various investigations into the crystallization of crystalline polyesters have already been carried out, and art has been disclosed with regard, for example, to the co-use therewith of a nucleating agent or wax.

The present inventors, although having focused on the wax, were unable to achieve a desired microdispersion even when using the crystalline polyester used by the present invention in combination with, for example, carnauba wax, a conventional wax.

A cause here is thought to be the structural differences between the two, i.e., the crystalline polyester and wax, and according to investigations by the present inventors it was necessary for specific comparable structures to be present in the molecular structures of both.

Specifically, the structures are as follows.

The ester wax satisfies the following condition (i) or (ii).

(i) The ester wax contains an ester compound; this ester compound has a partial structure represented by the following formula (1) in the partial structures derived from the alcohol component; and the content of this ester compound based on the ester wax is at least 90% by mass.

(ii) The ester wax contains an ester compound; this ester compound has a partial structure represented by the following formula (2) in the partial structures derived from the carboxylic acid component; and the content of this ester compound based on the ester wax is at least 90% by mass.

$$—O—C_xH_{2x}—O— \text{ or } —C_xH_{2x+1}—O— \quad (1)$$

(In formula (1), x represents an integer from 6 to 12.)

$$—\overset{O}{\overset{\|}{C}}—C_yH_{2y}—\overset{O}{\overset{\|}{C}}— \text{ or } C_yH_{2y+1}—\overset{O}{\overset{\|}{C}}— \quad (2)$$

(In formula (2), y represents an integer from 4 to 10.)

The crystalline polyester, on the other hand, satisfies the following condition (iii) or (iv).

(iii) The crystalline polyester has a partial structure represented by the following formula (3), and the content of the partial structure represented by formula (3) is at least 90 mol % based on the total number of moles of diol component-derived partial structures in the crystalline polyester.

(iv) The crystalline polyester has a partial structure represented by the following formula (4), and the content of the partial structure represented by formula (4) is at least 90 mol % based on the total number of moles of dicarboxylic acid component-derived partial structures in the crystalline polyester.

$$—O—C_xH_{2x}—O— \quad (3)$$

(In formula (3), x represents an integer from 6 to 12.)

$$—\overset{O}{\overset{\|}{C}}—C_yH_{2y}—\overset{O}{\overset{\|}{C}}— \quad (4)$$

(In formula (4), y represents an integer from 4 to 10.)

The crystalline polyester and ester wax present in the toner in the present invention will each be described.

Crystalline polyester has a structure provided by the condensation polymerization of a diol component with a dicarboxylic acid component. Crystalline polyester exhibits a distinct melting point peak in differential scanning calorimetric measurement using a differential scanning calorimeter (DSC).

The crystalline polyester of the present invention characteristically contains, as the diol component or dicarboxylic acid component, a specific proportion of a hydrocarbon chain that has a specific length.

The length of the hydrocarbon chain is determined by the values of x and y in formulas (3) and (4), and the crystallinity declines when these are below their lower limits. For example, when the toner is produced in an aqueous medium, negative results are seen, e.g., encapsulation within the toner particle is impeded and the effects are not achieved.

In specific terms, the effect on the durability at low temperatures is not seen when in formulas (3) and (4) x is 5 or less and y is 3 or less. When, on the other hand, x is 13 or more and y is 11 or more, the solubility of the crystalline polyester itself declines and, accompanying the reduction in the manufacturability of the toner, the developing performance and/or fixing performance end up declining.

While the crystalline polyester should satisfy condition (iii) or (iv) in the present invention, it preferably satisfies both conditions (iii) and (iv).

Moreover, the sum of x and y also exercises an influence on the fixing performance and the durability. Specifically, preferably condition (iii) or (iv) is satisfied and x+y is an integer from 14 to 20.

In addition, when the dicarboxylic acid component-derived partial structure and the diol component-derived partial structure are comparable or similar structures in order to promote crystallization of the crystalline polyester, infra, the low-temperature durability is then further enhanced and this case is thus preferred.

Specifically, preferably (iii) or (iv) is satisfied and the absolute value of the difference between x and y is not more than 10 and more preferably not more than 8. The reason for this is as follows: when the molecular chains of the polyester undergo folding during crystallization, the occurrence of a construction in which there is high affinity between the parallel main chains is advantageous for crystallization.

In (iii), the content of the partial structure represented by formula (3) is at least 90 mol % based on the total number of moles of diol component-derived partial structures in the crystalline polyester.

In (iv), on the other hand, the content of the partial structure represented by formula (4) is at least 90 mol % based on the total number of moles of dicarboxylic acid component-derived partial structures in the crystalline polyester.

For example, in the case of a crystalline polyester that uses 100 mol % 1,10-decanediol for the diol component and 90 mol % sebacic acid and 10 mol % succinic acid for the dicarboxylic acid component, the content of the partial structure with formula (3) based on the total number of moles of the diol component-derived partial structures is 100 mol %, and the content of the partial structure with formula (4) is 90 mol % based on the total number of moles of the dicarboxylic acid component-derived partial structures.

When, for the crystalline polyesters in Tables 3-1 and 3-2 below, a plurality of diol components and/or a plurality of dicarboxylic acid components is used, the x and y in formula (3) and formula (4) indicate the value for the partial structure having the largest content.

The ester wax is described in the following.

First, the ester wax of the present invention has a peak top temperature for the maximum endothermic peak measured with a differential scanning calorimeter of at least 65° C. and not more than 85° C. and preferably at least 70° C. and not more than 80° C.

At a peak top temperature for the maximum endothermic peak of less than 65° C., the storability of the toner undergoes a substantial decline, while the decline in the fixing performance becomes substantial when 80° C. is exceeded.

A characteristic feature of the ester wax of the present invention, on the other hand, is that it has a specific content of an ester compound that has, as its alcohol component or carboxylic acid component, a hydrocarbon chain with a specific length.

Here, when the ester wax contains 95% by mass of an ester compound that has a partial structure with formula (1) and 5% by mass of an ester compound that does not have a partial structure with formula (1) and does not have a partial structure with formula (2), the content of the ester compound having a partial structure with formula (1) based on the ester wax is then 95% by mass.

The reason for the use of these characteristic structural features in the ester wax is to provide a structure similar or comparable to that of the crystalline polyester. The thinking underlying this reason will be described from the standpoint of promoting the microdispersion of the crystalline polyester within the toner and promoting the crystallization of the crystalline polyester.

First, with regard to promoting the microdispersion of the crystalline polyester, specifying that the ester wax and crystalline polyester have a similar or common partial structure results in the solubility parameters of the ester wax and crystalline polyester being in part very close to each other. In general, species that have solubility parameters close to one another have a high affinity for one another, and it is thought that as a consequence an ester wax and crystalline polyester that have similar or common partial structures are then prone to exhibit affinity at these structural moieties.

When, on the other hand, a comparison is made of the compatibility—as a characteristic feature of ester waxes that conform to the range indicated above for the peak top temperature of the maximum endothermic peak—with, for example, the polyester resins and styrene-acrylic acid-type copolymers that are the usual binder resins used in toners, it tends to be high with hydrocarbon waxes. Here, "compatibility" denotes the ease of mixing and ease of dispersion at the molecular level in the binder resin.

Given this, it is thought that the instant ester wax has a high compatibility with both the crystalline polyester and the binder resin. Accordingly, it is thought that the dispersion of the crystalline polyester in the binder resin is dramatically promoted by the action of this ester wax as a dispersion assistant between the crystalline polyester and binder resin.

With regard to the promotion of the crystallization of the crystalline polyester, the point at which the crystalline polyester undergoes crystallization is considered in the following. In the case of a crystalline polyester having a molecular chain of a certain length, the molecular chains undergoing folding and crystallization occurs with the main chain sections aligned. It is thought that as a result, when a structure similar to this main chain is also present in the ester wax, the ester wax readily forms an initiation point for the crystallization of the crystalline polyester and crystallization is then significantly promoted.

In addition to regulating the structures of the crystalline polyester and ester wax as described above, characteristic features in the present invention are regulation of the content of the crystalline polyester relative to the binder resin and regulation of the mass ratio between the ester wax and the crystalline polyester.

Specifically, the toner of the present invention contains from 3.0 parts by mass to 20.0 parts by mass of the crystalline polyester per 100 parts by mass of the binder resin and has a mass ratio of the ester wax to crystalline polyester (ester wax/crystalline polyester) of from 25/75 to 75/25.

When the content of the crystalline polyester is less than 3.0 parts by mass, the fixing performance undergoes a substantial decline in combination with the low-temperature durability assuming a declining trend. When, on the other hand, 20.0 parts by mass is exceeded, the developing performance and the low-temperature durability undergo a substantial decline.

When the mass ratio of the ester wax to crystalline polyester is less than 25/75 (i.e., 0.33), the dispersion-promoting effect of the ester wax on the crystalline polyester is not obtained and the low-temperature durability declines in combination with the fixing performance assuming a declining trend. When, on the other hand, 75/25 (i.e., 3.00) is exceeded, crystallization of the ester wax itself is promoted due to the ratio of the ester wax-to-ester wax interaction becoming higher than for the crystalline polyester, and obtaining the effects of the present invention is then impeded.

The content of the crystalline polyester in the present invention is preferably from 5.0 parts by mass to 20.0 parts by mass per 100 parts by mass of the binder resin, while the mass ratio of the ester wax to crystalline polyester is preferably from 25/75 to 70/30.

The toner of the present invention is described in detail in the following, but this should not be construed as a limitation to this description.

The ester wax is considered first.

The ester wax of the present invention has a peak top temperature for the maximum endothermic peak measured with a differential scanning calorimeter of from 65° C. to 85° C., and an ester wax that satisfies the previously indicated condition (i) or (ii) can be used.

In addition, it may also be used in the present invention, in a range in which the effects of the present invention are not impaired, in combination with a release agent other than the instant ester wax and/or in combination with an ester wax that does not satisfy the aforementioned conditions.

In the present invention, the ester wax contains an ester compound that has an ester bond provided by the condensation of a hydroxyl group originating from an alcohol component with a carboxyl group originating from a carboxylic acid component.

Ester compounds that have a single ester bond in the individual ester compound molecule can be exemplified in the present invention by the condensation product between a $C_{6-12}$ aliphatic alcohol and a long-chain carboxylic acid and the condensation product of a $C_{5-11}$ aliphatic carboxylic acid molecule and a long-chain alcohol. While any long-chain carboxylic acid and long-chain alcohol can be used here, the monomers should be combined as appropriate such that the previously indicated peak top temperature for the maximum endothermic peak can be satisfied.

Aliphatic monoalcohols that give the formula (1) partial structure can be exemplified by 1-hexanol, 1-heptanol, 1-octanol, 1-nonanol, 1-decanol, undecyl alcohol, and lauryl alcohol. Aliphatic monocarboxylic acids that give the formula (2) partial structure can be exemplified by pentanoic acid, hexanoic acid, heptanoic acid, octanoic acid, nonanoic acid, decanoic acid, and undecanoic acid.

Ester compounds that have two ester bonds in the individual molecule can be exemplified by esters between a dicarboxylic acid and an aliphatic monoalcohol and esters between a diol and an aliphatic monocarboxylic acid. Here, the partial structure represented by formula (1) or (2) is preferably provided by a structure derived from a dicarboxylic acid or a diol.

Diols that give a formula (1) partial structure can be exemplified by 1,6-hexanediol, 1,7-heptanediol, 1,8-octanediol, 1,9-nonanediol, 1,10-decanediol, 1,11-undecanediol, and 1,12-dodecanediol.

Dicarboxylic acids that give a formula (2) partial structure can be exemplified by adipic acid, pimelic acid, suberic acid, azelaic acid, decanedioic acid, undecanedioic acid, and dodecanedioic acid. While examples of straight-chain aliphatic acids and straight-chain alcohols are given here, the presence of a branched structure is unproblematic. Among the preceding, 1,6-hexanediol, 1,9-nonanediol, 1,10-decanediol, and 1,12-dodecanediol are preferred, while 1,9-nonanediol and 1,10-decanediol readily achieve the effects of the present invention and thus are particularly preferred.

Aliphatic monoalcohols for condensation with the aforementioned dicarboxylic acids can be exemplified by tetradecanol, pentadecanol, hexadecanol, heptadecanol, octadecanol, nonadecanol, eicosanol, docosanol, tricosanol, tetracosanol, pentacosanol, hexacosanol, and octacosanol. Among these, docosanol is preferred from the standpoint of the fixing performance and developing performance.

Aliphatic monocarboxylic acids for condensation with the aforementioned diols can be exemplified by lauric acid, myristic acid, palmitic acid, margaric acid, stearic acid, tuberculostearic acid, arachidic acid, behenic acid, lignoceric acid, and cerotic acid. Behenic acid is preferred among the preceding from the standpoint of the fixing performance and development performance.

Ester compounds having three ester bonds in the individual molecule may also be used.

Ester compounds having three ester bonds in the individual molecule can be exemplified by esters (condensation products) between a glycerol compound and an aliphatic monocarboxylic acid. Ester compounds having four ester bonds in the individual molecule can be exemplified by esters (condensation products) between pentaerythritol and an aliphatic monocarboxylic acid and esters (condensation products) between diglycerol and an aliphatic monocarboxylic acid. Ester compounds having five ester bonds in the individual molecule can be exemplified by esters (condensation products) between triglycerol and an aliphatic monocarboxylic acid. Ester compounds having six ester bonds in the individual molecule can be exemplified by esters (condensation products) between dipentaerythritol and an aliphatic monocarboxylic acid and esters (condensation products) between tetraglycerol and an aliphatic monocarboxylic acid.

In the present invention, the ester wax preferably contains an ester compound having two ester bonds in the individual molecule that is an ester between a diol and an aliphatic monocarboxylic acid or an ester between a dicarboxylic acid and an aliphatic monoalcohol.

Ester compounds having two ester bonds in the individual molecule are favorable because they readily simultaneously satisfy both the aforementioned structures and the previously indicated peak top temperature of the maximum endothermic peak. In addition, they also have an excellent compatibility with the binder resin and facilitate achieving the effects of the present invention.

Moreover, when the main component is an ester compound having two ester bonds in the individual molecule and represented by the following formula (5) or (6), a trend of an increasing durability occurs and this is thus preferred. Here, "main component" means that the total amount of component represented by formula (5) or (6) accounts for at least 50% by mass of the total ester wax.

$$R_1—CO—O—(C_xH_{2x})—O—OC—R_2 \quad \text{formula (5):}$$

$$R_3—O—OC—(C_yH_{2y})—CO—O—R_4 \quad \text{formula (6):}$$

In formulas (5) and (6), preferably $R_1$ to $R_4$ are alkyl groups and x is an integer from 6 to 12. Preferably y is an integer from 4 to 10.

More preferably, $R_1$ and $R_2$ are $C_{17-23}$ alkyl groups and $R_3$ and $R_4$ are $C_{18-24}$ alkyl groups.

An ester wax with a controlled composition distribution is preferably used for the ester wax in the present invention. Specifically, in the composition distribution of the ester wax measured by GC-MASS or MALDI TOF MASS, the content of the ester compound having the largest content is preferably from 40% by mass to 80% by mass based on the total amount of the ester wax.

This means that a distribution in the composition is desirably present to a certain degree in the ester wax. When it is the range indicated above, the compatibility with the binder resin is increased and the dispersion-promoting effect described above is increased, and this is therefore preferred. From 50% by mass to 80% by mass is more preferred.

In addition, the ester wax, while having a composition distribution as indicated above, preferably has a molecular weight distribution that has a certain degree of sharpness. Specifically, the total content of ester compounds having a molecular weight M that satisfies $0.8\times M1 \leq M \leq 1.2\times M1$, where M1 is the molecular weight of the ester compound having the largest content in the ester wax, is preferably at least 90% by mass based on the total amount of the ester wax. This means that a large portion of the ester wax is composed of structurally close ester compounds that fit into a molecular weight difference of about 20%. At within the indicated range, the above-described microdispersion of the crystalline polyester can be evenly exhibited, and this is therefore preferred.

The crystalline polyester is described in the following.

The crystalline polyester of the present invention satisfies the aforementioned condition (iii) or (iv). Specifically, it is preferably the condensation product of an aliphatic dicarboxylic acid with an aliphatic diol. Saturated polyesters are more preferred.

Examples are provided below of the monomers that can be used when it is the condensation product of an aliphatic dicarboxylic acid and an aliphatic diol and is a saturated polyester.

Aliphatic dicarboxylic acids can be exemplified by oxalic acid, malonic acid, succinic acid, glutaric acid, adipic acid, pimelic acid, suberic acid, azelaic acid, decanedioic acid, undecanedioic acid, and dodecanedioic acid.

Aliphatic diols can be exemplified by ethylene glycol, diethylene glycol, triethylene glycol, 1,2-propylene glycol, 1,3-propylene glycol, dipropylene glycol, trimethylene glycol, neopentyl glycol, 1,4-butanediol, 1,6-hexanediol, 1,7-heptanediol, 1,8-octanediol, 1,9-nonanediol, 1,10-decanediol, 1,11-undecanediol, and 1,12-dodecanediol.

From the standpoint of the crystallinity of the crystalline polyester, the content of linear chain type aliphatic dicarboxylic acid in the carboxylic acid component is preferably at least 80 mol % and more preferably at least 90 mol % and is even more preferably 100 mol %.

From the standpoint of the crystallinity of the crystalline polyester, the content of linear chain type aliphatic diol in the diol component is preferably at least 80 mol % and more preferably at least 90 mol % and is even more preferably 100 mol %.

In the present invention, the content of the partial structure with formula (3) based on the total number of moles of diol component-derived partial structures in the crystalline polyester and the content of the partial structure with formula (4) based on the total number of moles of dicarboxylic acid component-derived partial structures in the crystalline polyester can be determined from the integration values in the spectrum for the crystalline polyester obtained by nuclear magnetic spectrometric analysis ($^1$H-NMR).

The crystalline polyester of the present invention can be produced by the usual methods for polyester synthesis. For example, it can be obtained by carrying out an esterification reaction or transesterification reaction between the dicarboxylic acid component and diol component and then carrying out a polycondensation reaction according to an ordinary method under reduced pressure or with the introduction of nitrogen gas.

As necessary, an ordinary esterification catalyst or transesterification catalyst, for example, sulfuric acid, tertiary-butyltitanium butoxide, dibutyltin oxide, manganese acetate, magnesium acetate, and so forth, can be used in the esterification or transesterification reaction. With regard to the polymerization, an ordinary polymerization catalyst, for example, a known polymerization catalyst such as tertiary-butyltitanium butoxide, dibutyltin oxide, tin acetate, zinc acetate, tin disulfide, antimony trioxide, germanium dioxide, and so forth can be used. There are no particular limitations on the polymerization temperature and the amount of catalyst and these may be freely selected as necessary.

A titanium catalyst is preferably used as the catalyst, and a chelate-type titanium catalyst is more preferred. This is because titanium catalysts have a favorable reactivity and a polyester having the molecular weight indicated below is readily obtained.

The weight-average molecular weight (Mw) of the crystalline polyester is preferably from 10,000 to 40,000 in the present invention, while from 10,000 to 30,000 is more preferred. This makes it possible to rapidly obtain a plasticizing effect by the crystalline polyester in the fixing step while maintaining a high degree of crystallinity for the crystalline polyester.

The weight-average molecular weight (Mw) of the crystalline polyester can be controlled using various conditions in the production of the crystalline polyester.

Considering the dispersibility within the toner, the acid value of the crystalline polyester is preferably kept low. Specifically, not more than 8.0 mg KOH/g is preferred, not more than 5.0 mg KOH/g is more preferred, and not more than 3.5 mg KOH/g is even more preferred.

The colorant used in the present invention can be exemplified by the following organic pigments, organic dyes, and inorganic pigments. The cyan colorants can be exemplified by copper phthalocyanine compounds and derivatives thereof, anthraquinone compounds, and base dye lake compounds.

Specific examples are as follows: C. I. Pigment Blue 1, 7, 15, 15:1, 15:2, 15:3, 15:4, 60, 62, and 66.

The magenta colorants can be exemplified by the following: condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are as follows: C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, and 254 and C. I. Pigment Violet 19.

The yellow colorants can be exemplified by condensed azo compounds, isoindolinone compounds, anthraquinone compounds, azo metal complexes, methine compounds, and allylamide compounds.

Specific examples are as follows: C. I. Pigment Yellow 12, 13, 14, 15, 17, 62, 74, 83, 93, 94, 95, 97, 109, 110, 111, 120, 127, 128, 129, 147, 151, and 154 and C. I. Pigment Yellow 155, 168, 174, 175, 176, 180, 181, 185, 191, and 194.

The black colorant can be exemplified by carbon black and black colorants provided by color matching to black using the aforementioned yellow colorants, magenta colorants, and cyan colorants, and a magnetic body.

A single one of these colorants may be used, or a mixture may be used, or they may be used in the form of a solid solution. The colorant used in the present invention is selected considering the hue angle, chroma, lightness, lightfastness, OHP transparency, and dispersibility in the toner particle.

For the use of a colorant other than a magnetic body, the content of the colorant is preferably from 1.0 parts by mass to 20.0 parts by mass per 100 parts by mass of the binder resin. When a magnetic body is used as the colorant, from 50.0 parts by mass to 150.0 parts by mass per 100 parts by mass of the binder resin is preferred.

The following, for example, can be used as the binder resin used in the present invention: homopolymers of styrene and derivatives thereof, such as polystyrene and polyvinyltoluene; styrenic copolymers such as styrene-propylene copolymers, styrene-vinyltoluene copolymers, styrene-vinylnaphthalene copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; styrene-acrylic acid-type copolymers such as styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, and styrene-dimethylaminoethyl methacrylate copolymers; as well as polymethyl methacrylate, polybutyl methacrylate, polyvinyl acetate, polyethylene, polypropylene, polyvinyl butyral, silicone resins, polyester resins, polyamide resins, epoxy resins, and polyacrylic acid resins.

A single one of these may be used or a combination of a plurality may be used. Among the preceding, styrene-acrylic acid-type copolymers, as represented by styrene-butyl acrylate copolymers, are particularly preferred from the standpoint of the developing characteristics and fixing performance.

Preferably a styrene-acrylic acid-type copolymer is the main component of the binder resin in the present invention. Specifically, the binder resin contains, with reference to the total amount of the binder resin, preferably at least 50% by mass, more preferably at least 70% by mass, and even more preferably at least 80% by mass of a styrene-acrylic acid-type copolymer as described above. Combinations of other known resins can also be used for the binder resin.

The polymerizable monomer that forms the aforementioned homopolymers and copolymers can be exemplified by the following:

styrene, α-methylstyrene, o-methylstyrene, m-methylstyrene, p-methylstyrene, p-methoxystyrene, methyl acrylate, ethyl acrylate, n-propyl acrylate, isopropyl acrylate, n-butyl acrylate, isobutyl acrylate, tert-butyl acrylate, n-hexyl acrylate, 2-ethylhexyl acrylate, n-octyl acrylate, cyclohexyl acrylate, methyl methacrylate, ethyl methacrylate, n-propyl methacrylate, isopropyl methacrylate, n-butyl methacrylate, isobutyl methacrylate, tert-butyl methacrylate, n-hexyl methacrylate, 2-ethylhexyl methacrylate, and n-octyl methacrylate.

There are no particular limitations on the method of producing these homopolymers and copolymers, and known methods can be used.

The toner of the present invention may contain a magnetic body.

When a magnetic body is used, the magnetic body has as its main component a magnetic iron oxide such as triiron tetroxide or γ-iron oxide, and may contain an element such as phosphorus, cobalt, nickel, copper, magnesium, manganese, aluminum, silicon, and so forth. This magnetic body has a BET specific surface area by the nitrogen adsorption method preferably of 2 to 30 $m^2/g$ and more preferably of 3 to 28 $m^2/g$. Its Mohs hardness is preferably 5 to 7. The shape of the magnetic body is, for example, polyhedral, octahedral, hexahedral, spherical, acicular, or scale, and a low-anisotropy magnetic body, e.g., polyhedral, octahedral, hexahedral, spherical, and so forth, is preferred from the standpoint of increasing the image density.

The magnetic body preferably has a number-average particle diameter of 0.10 to 0.40 μm. Generally, a smaller particle diameter for the magnetic body, while raising the tinting strength, also facilitates aggregation of the magnetic body and thus facilitates a reduction in the uniform dispersibility of the magnetic body in the toner.

When the number-average particle diameter is at least 0.10 μm, this inhibits the magnetic body itself from becoming reddish black and in particular for halftone images suppresses the formation of an image in which red is prominent. On the other hand, the tinting strength of the toner is further increased when the number-average particle diameter is equal to or less than 0.40 μm.

The number-average particle diameter of the magnetic body can be measured using a transmission electron microscope.

Specifically, the toner particles to be observed are thoroughly dispersed in an epoxy resin and a cured material is then obtained by curing for 2 days in an atmosphere with a temperature of 40° C. A thin-section sample of the obtained cured material is prepared with a microtome, and the particle diameter of 100 magnetic bodies is measured in the field of view of a photograph at a magnification of 10,000× to 40,000× using a transmission electron microscope (TEM). The number-average particle diameter is determined based on the equivalent diameter of the circle that is equal to the projected area of the magnetic body. The particle diameter can also be measured using an image analyzer.

The magnetic body can be produced, for example, by the following method. An alkali, for example, sodium hydroxide, is added, in an equivalent or greater amount with reference to the iron component, to an aqueous ferrous salt solution to prepare an aqueous solution containing ferrous hydroxide. Air is blown in while holding the pH of the prepared aqueous solution at or above pH 7 and an oxidation reaction is run on the ferrous hydroxide while heating the aqueous solution to at least 70° C. to first produce seeds that will become the core of the magnetic iron oxide.

This is followed by the addition, to the seed-containing slurry, of an aqueous solution containing ferrous sulfate at approximately 1 equivalent based on the amount of the previously added alkali. The reaction of the ferrous hydroxide is advanced while blowing in air and while holding the pH of the liquid at 5 to 10, and the magnetic iron oxide is grown using the seeds as cores. At this time, the shape and magnetic characteristics of the magnetic body can be controlled through free selection of the pH and the reaction temperature and stirring conditions. As the oxidation reaction advances, the pH of the liquid will shift to the acidic side, but the pH of the liquid preferably does not fall below 5. The magnetic body can be obtained by subjecting the thusly obtained magnetic body to filtration, washing, and drying by conventional methods.

In addition, when the toner is produced in the present invention in an aqueous medium, preferably the surface of the magnetic body is subjected to a hydrophobic treatment. When the surface treatment is performed by a dry method, treatment with a coupling agent is carried out on the washed, filtered, and dried magnetic body. When the surface treatment is carried out by a wet method, after the completion of the oxidation reaction the dried material is redispersed—or after the completion of the oxidation reaction the iron oxide body obtained by washing and filtration is redispersed in a separate aqueous medium without drying—and the coupling treatment is then carried out. Either a dry method or wet method can be selected in the present invention as appropriate.

Coupling agents that can be used for the surface treatment of the magnetic body can be exemplified by silane compounds, silane coupling agents, and titanium coupling agents. Silane compounds and silane coupling agents are more preferably used and are given by the following formula (I).

$$R_mSiY_n \quad (I)$$

[In the formula, R represents an alkoxy group; m represents an integer from 1 to 3; Y represents a functional group such as an alkyl group, phenyl group, vinyl group, epoxy group, acrylic group, methacrylic group, and so forth; and n represents an integer from 1 to 3 wherein m+n=4.]

Silane coupling agents with formula (I) can be exemplified by vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, and hydroxypropyltrimethoxysilane.

Silane compounds with formula (I) can be exemplified by methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, n-hexadecyltrimethoxysilane, and n-octadecyltrimethoxysilane.

The use is preferred of compounds in which Y in formula (I) is an alkyl group. Among these, alkyl groups having 3 to 6 carbons are preferred and 3 or 4 is particularly preferred.

When a silane compound or silane coupling agent is used, treatment may be performed with a single one or treatment may be carried out using a combination of a plurality of species. When a combination of a plurality of species is used, treatment may be carried out using each coupling agent separately or treatment may be carried out using them simultaneously.

The total amount of treatment with the silane compound or coupling agent used is preferably from 0.9 parts by mass to 3.0 parts by mass based on 100 parts by mass of the magnetic body. The amount of treatment agent should be adjusted in conformity with the surface area of the magnetic body, the reactivity of the silane compound or coupling agent, and so forth.

The content of the magnetic body in the toner can be measured using the TGA7 thermal analyzer from PerkinElmer Inc. The measurement method is as follows. The toner is heated from normal temperature to 900° C. at a ramp rate of 25° C./min in a nitrogen atmosphere. The % by mass lost from 100° C. to 750° C. is taken to be the amount of the binder resin, and the remaining mass is taken to be approximately the amount of the magnetic body.

The weight-average particle diameter (D4) of the toner of the present invention is preferably from 3.0 μm to 12.0 μm and is more preferably from 4.0 μm to 10.0 μm. When the weight-average particle diameter (D4) is from 3.0 μm to 12.0 μm, an excellent fluidity is then obtained and the latent image can be faithfully developed.

The toner of the present invention can be produced by any known method.

First, in the case of production by a pulverization method, for example, the binder resin, colorant, ester wax-containing release agent, and crystalline polyester, and as necessary other additives, e.g., a charge control agent, are thoroughly mixed using a mixer such as, for example, a Henschel mixer or ball mill. After this, the toner raw materials are mixed or dissolved by melt kneading using a heated kneader such as a hot roll, kneader, or extruder, followed by cooling and solidification, pulverization, then classification, and as necessary a surface treatment, to obtain the toner particle. With regard to the sequence for classification and the surface treatment, either may be first. From the standpoint of production efficiency, a multi-grade classifier is preferably used for classification.

Pulverization can be carried out by a method that uses a known pulverizing apparatus, for example, a mechanical impact type or a jet type. In addition, preferably pulverization is carried out with the application of additional heating and/or a treatment is carried out in which a mechanical impact is applied on an auxiliary basis. Moreover, for example, a hot water bath method may be used in which the finely pulverized (and optionally classified) toner particles are dispersed in hot water and/or a method may be used in which they are passed through a hot gas current.

The means for the application of a mechanical impact force can be exemplified by a method that uses a mechanical impact-type pulverizing apparatus such as a Kryptron System from Kawasaki Heavy Industries, Ltd. or a Turbomill from Turbo Kogyo Co., Ltd. Another example is a method in which a mechanical impact force is applied to the toner particle by a force, such as a compressive force, frictional force, and so forth, by pressing the toner by centrifugal force to the inside of a casing using blades rotating at high speed, as in devices such as the Mechanofusion System from Hosokawa Micron Corporation and the Hybridization System from Nara Machinery Co., Ltd.

As necessary, the toner can be obtained by mixing inorganic fine particles, infra, with the obtained toner particles to attach the former to the toner particle surface.

The toner of the present invention can be produced by the pulverization method as described above, but the toner may also be produced in an aqueous medium using, for example, the suspension polymerization method. The suspension polymerization method is preferred because it facilitates control of the promotion of microdispersion and crystallization of the crystalline polyester.

The suspension polymerization method is described in the following.

In the suspension polymerization method, polymerizable monomer that will form the binder resin, colorant, ester wax-containing release agent, and crystalline polyester and as necessary a polymerization initiator, crosslinking agent, charge control agent, and other additives are dissolved or dispersed to uniformity to obtain a polymerizable monomer composition. After this, the polymerizable monomer composition is dispersed, using a suitable stirrer, in a continuous phase (for example, a water phase) that contains a dispersion stabilizer to form particles of the polymerizable monomer composition, and toner particles having a desired particle diameter are then obtained by polymerization of the polymerizable monomer in the polymerizable monomer composition. Toner particles obtained by this suspension polymerization method can be expected to provide an improved image quality because the shape of the individual toner particles is uniformly approximately spherical and the distribution of the amount of charge is therefore also relatively uniform.

The polymerization initiator preferably has a half-life of 0.5 to 30 hours at the polymerization reaction temperature. When the polymerization reaction is carried out using an amount of addition of from 0.5 parts by mass to 20 parts by mass per 100 parts by mass of the polymerizable monomer, a polymer can be obtained that has a maximum between a molecular weight of 5,000 to 50,000, and the toner can then be provided with a desirable strength and favorable melting characteristics.

Specific examples are azo-type polymerization initiators and diazo-type polymerization initiators such as 2,2'-azobis (2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile and peroxide-type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, and t-butyl peroxypivalate.

A compound having at least two polymerizable double bonds is mainly used as the aforementioned crosslinking agent. Examples are aromatic divinyl compounds such as divinylbenzene and divinylnaphthalene; carboxylate esters having two double bonds, such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; and compounds that have three or more vinyl groups. A single one of these may be used or a mixture of two or more may be used.

The amount of addition of the crosslinking agent is preferably from 0.001 parts by mass to 15 parts by mass per 100 parts by mass of the polymerizable monomer.

A known surfactant, organic dispersant, or inorganic dispersant can be used as the aforementioned dispersion stabilizer. Among these, the use of inorganic dispersion stabilizers is preferred because they suppress the formation of harmful ultrafine powder; because they provide dispersion stability through steric hindrance, which makes the stability resistant to disruption even when the reaction temperature is changed; and because washing is also easy and exercising negative effects on the toner is thus suppressed.

These inorganic dispersion stabilizers can be exemplified by multivalent metal salts of phosphoric acid, e.g., tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

These inorganic dispersion stabilizers are preferably used at from 0.2 parts by mass to 20 parts by mass per 100 parts by mass of the polymerizable monomer. A single one of these inorganic dispersion stabilizers may be used or a plurality may be used in combination. A surfactant may be co-used at from 0.001 parts by mass to 0.1 parts by mass per 100 parts by mass of the polymerizable monomer.

In the case of use of these inorganic dispersion stabilizers, they may be used as such or, in order to obtain even finer particles, they may also be used by producing particles of the inorganic dispersion stabilizer in the aqueous medium. For example, in the case of tricalcium phosphate, water-insoluble calcium phosphate can be produced by mixing an aqueous sodium phosphate solution with an aqueous calcium chloride solution under high-speed stirring, and this makes possible a more uniform and finer dispersion. While the water-soluble sodium chloride salt is also produced here as a secondary product, the presence of a water-soluble salt in the aqueous medium inhibits the dissolution of the polymerizable monomer in water and suppresses the production of ultrafine toner particles by emulsion polymerization and is thus a favorable circumstance.

The surfactant can be exemplified by sodium dodecylbenzene sulfate, sodium tetradecyl sulfate, sodium pentadecyl sulfate, sodium octyl sulfate, sodium oleate, sodium laurate, sodium stearate, and potassium stearate.

The polymerization temperature is set to at least 40° C. and generally to from 50° C. to 90° C. in the step of polymerizing the polymerizable monomer. When the polymerization is carried out in this temperature range, the ester wax to be sealed in the interior undergoes precipitation by phase separation and is more completely encapsulated.

After polymerization of the polymerizable monomer has been completed and the colored particles have been obtained, and while in a state in which the colored particles are dispersed in the aqueous medium, the temperature should be raised to a temperature that exceeds the melting points of the crystalline polyester and the release agent. This step is unnecessary when the polymerization temperature exceeds these melting points.

With regard to the cooling rate subsequent to this, the preferred range for the present invention will be described for toner production methods as a whole and not simply for the suspension polymerization method described above.

When toner production is carried out by, for example, the pulverization method, suspension polymerization, emulsion polymerization, and so forth, a step is frequently included in which, in order to bring about crystallization of, inter alia, the crystalline polyester, the temperature is raised to a temperature at which the crystalline polyester and ester wax undergo melting followed by cooling to normal temperature.

Considering the cooling step, as the temperature declines, the molecular motion of the crystalline polyester—which has been liquefied by the heating—slows down and crystallization starts when the neighborhood of the crystallization temperature is reached. Upon further cooling, crystallization advances and complete solidification occurs at normal temperature.

According to investigations by the present inventors, it was found that the amount of the final crystallization by the crystalline polyester varies according to the cooling rate. Specifically, a trend occurred in which the amount of crystal increased when cooling from a temperature equal to or greater than the melting point of the crystalline polyester to a temperature equal to or less than the glass transition temperature of the toner particle was carried out at a rate of at least 5.0° C./minute. While the details here are unclear, it is thought that the crystallization of the ester wax is suppressed when this cooling condition is implemented and that the crystallization of the crystalline polyester can then proceed in a state that enables better functioning as a nucleating agent for the crystalline polyester.

The obtained toner particles are then subjected to filtration, washing, and drying by known methods to obtain toner particles. The toner can be obtained as necessary by mixing these toner particles with inorganic fine particles as described below in order to attach them to the toner particle surface. A classification step may also be introduced into the production process (prior to mixing with the inorganic fine particles) in order to cut out the coarse powder and fines present in the toner particles.

The mixing of the inorganic fine particles may be carried out using a mixing apparatus such as, for example, a Henschel mixer. The inorganic fine particles preferably have a number-average particle diameter for the primary particles of from 4 nm to 80 nm and more preferably from 6 nm to 40 nm.

The inorganic fine particles are added in order to improve the flowability of the toner and make charging uniform, but providing additional functionalities, such as adjusting the amount of charge and improving the environmental stability, by subjecting the inorganic fine particles to a hydrophobic treatment is also a preferred mode.

The treatment agent used for the hydrophobic treatment of the inorganic fine particles can be exemplified by silicone varnishes, variously modified silicone varnishes, silicone oils, variously modified silicone oils, silane compounds, silane coupling agents, organosilicon compounds other than the preceding, and organotitanium compounds. A single one of these treatment agents may be used or two or more may be used in combination.

The number-average particle diameter of the primary particles of the inorganic fine particles is measured using a photograph of the toner enlarged using a scanning electron microscope.

For example, silica fine particles, titanium oxide fine particles, and alumina fine particles can be used as the instant inorganic fine particles. Either a dry silica known as dry-method or fumed silica, and produced by the vapor-phase oxidation of a silicon halide, or a wet silica produced from, for example, water glass, can be used as the silica fine particles. However, dry silica, which has little silanol group at the surface or within the silica fine particle and which has little residual $Na_2O$, $SO_3^{2-}$, and so forth from production, is preferred. Moreover, in the case of dry silica, composite fine particles of silica and another metal oxide can also be obtained by the use in the production process of another metal halide compound, for example, aluminum chloride, titanium chloride, and so forth, along with the silicon halide compound, and these are also encompassed by dry silica.

The amount of addition of the inorganic fine particles is preferably from 0.1 parts by mass to 3.0 parts by mass per 100 parts by mass of the toner particle. The amount of addition of the inorganic fine particles in the toner can be quantitatively determined using fluorescent x-ray analysis and using a calibration curve constructed from reference samples.

Other additives can also be used in small amounts in the toner of the present invention as developing performance improving agents within a range that does not cause substantial negative effects, for example, lubricant powders such as fluororesin powders, zinc stearate powders, and polyvinylidene fluoride powders; abrasives such as cerium oxide powder, silicon carbide powder, and strontium titanate powder; anti-caking agents; and reverse-polarity organic fine particles and inorganic fine particles. These additives may also be used after a surface hydrophobic treatment.

An example of an image-forming apparatus that can advantageously use the toner of the present invention will be specifically described using FIG. 1.

In FIG. 1, 100 is a photosensitive drum, and, for example, the following are disposed at its circumference: a primary charging roller 117, a developing having a developing sleeve 102, a transfer roller 114, a cleaner 116, and a register roller 124.

The photosensitive drum 100 is charged to, for example, −600 V (the applied voltage is, for example, an AC voltage of 1.85 kVpp or a DC voltage of −620 Vdc), by the primary charging roller 117. Photoexposure is carried out by irradiating the photosensitive member 100 with laser light 123 from a laser generator 121, and an electrostatic latent image that corresponds to the target image is thereby formed. The electrostatic latent image on the photosensitive drum 100 is developed by a single-component toner by the developing device 140 to obtain a toner image, and the toner image is transferred onto a transfer material by the transfer roller 114, which contacts the photosensitive member with the transfer material interposed therebetween. The transfer material bearing the toner image is moved to the fixing unit 126 by, for example, a transport belt 125, and fixing onto the transfer material is carried out. In addition, the toner remaining in part on the photosensitive member is cleaned off by the cleaner 116.

An image-forming apparatus that uses magnetic single-component jumping development is illustrated here, but this may be an image-forming apparatus used in either a jumping development method or a contact development method.

The methods of measuring the various properties pertinent to the toner of the present invention are described in the following.

<Measurement of, Inter Alia, the Structure and Content of the Crystalline Polyester and the Ester Compound>

The ester compound has a low molecular weight while the crystalline polyester has a molecular weight higher than this. The ester compound and crystalline polyester are separated from the toner utilizing this fact.

Specifically, 100 mg of the toner is dissolved in 3 mL of chloroform. The insoluble matter is then removed by suction filtration using a syringe equipped with a sample treatment filter (pore size from 0.2 μm to 0.5 μm, for example, a Sample Pretreatment Cartridge H-25-2 (Tosoh Corporation)). The soluble matter is introduced into a preparative HPLC (instrument: LC-9130 NEXT from Japan Analytical Industry Co., Ltd., preparative column [60 cm] exclusion limits: 20,000, 70,000, 2 column train) and a chloroform eluent is fed. Once a peak can be identified in the display of the obtained chromatogram, collection is performed before and after the retention time that gives a molecular weight of 5,000 for a monodisperse polystyrene standard sample.

After removal of the solvent from the collected solutions using an evaporator, vacuum drying is carried out for 24 hours to obtain a sample with a molecular weight below 5,000 (X component) and with a molecular weight at least 5,000 (Y component). The masses of X and Y are recorded.

Subsequent to this, the X component is heated using a JPS-700 pyrolyzer (Japan Analytical Industry Co., Ltd.) to 590° C. in the presence of tetramethylammonium hydroxide (TMAH) to effect thermal decomposition while carrying out methylation.

The total area is determined for the ester compound-derived alcohol component and carboxylic acid component, respectively, by GC-MASS (ISQ Focus GC from Thermo Fisher Scientific, HP-5MS [30 m]).

The ester compound composition can be elucidated by calculating the area ratios for the individual peaks, and the content (% by mass) referenced in (i) or (ii) is obtained.

The crystalline polyester composition can be similarly obtained by analysis of the Y component, and the content (mol %) referenced in (iii) or (iv) can be obtained.

Moreover, the ratio (mol %) between the binder resin and ester compound in component X is obtained by measuring the $^{1}$H-NMR of the X component under the conditions given below and taking the ratio between the binder resin-derived peak area and the ester compound-derived peak area.

The ester compound molecular weight is determined based on the ester compound structure obtained by the pyrolysis GC-MASS described above, and the mass ratio (% by mass) of the ester compound with reference to the binder resin is determined for the X component. Analysis and calculation are similarly also carried out for all the ester compounds and by taking this sum the mass ratio (% by mass) within the X component of the ester wax with reference to the binder resin is obtained.

Proceeding similarly for the Y component yields the mass ratio (% by mass) within the Y component of the crystalline polyester with respect to the binder resin.

Proceeding from these mass ratios and the masses of the X component and Y component, the ester compound content (parts by mass) and the crystalline polyester content (parts by mass) per 100 parts by mass of the binder resin in the toner are obtained, and, by also taking the ratio, the mass ratio between the ester wax and the crystalline polyester is obtained.

<$^{1}$H-NMR Measurement Conditions> measurement instrument: JNM-EX400 FT-NMR instrument (JEOL Ltd.)
measurement frequency: 400 MHz
pulse condition: 5.0 μs
frequency range: 10500 Hz
number of integrations: 64

<Measurement of the Peak Top Temperature of the Maximum Endothermic Peak of the Ester Wax and Measurement of the Melting Point of the Crystalline Polyester>

The peak top temperature of the maximum endothermic peak of the ester wax and crystalline polyester is measured based on ASTM D 3418-82 using a "Q1000" (TA Instruments) differential scanning calorimeter.

Temperature correction in the instrument detection section is performed using the melting points of indium and zinc, and the amount of heat is corrected using the heat of fusion of indium.

Specifically, approximately 2 mg of the sample is precisely weighed out and this is introduced into an aluminum pan, and the measurement is run at a ramp rate of 10° C./min in the measurement temperature range between 30° C. and 200° C. using an empty aluminum pan as reference. The measurement is carried out by initially raising the temperature to 200° C., then cooling to 30° C., and then reheating. The peak top temperature of the maximum endothermic peak in the DSC curve in the 30° C. to 200° C. temperature range is determined in this second ramp-up process.

When the sample is the ester wax, the peak top temperature of the maximum endothermic peak is also referred to in the present invention as the melting point of the ester wax.

In addition, when the sample is the crystalline polyester, the peak top temperature of the maximum endothermic peak is also referred as the melting point of the crystalline polyester.

<Measurement of the Weight-Average Particle Diameter (D4) and the Number-Average Particle Diameter (D1) of the Toner (Particle)>

Using a "Coulter Counter Multisizer 3" (registered trademark, from Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (from Beckman Coulter, Inc.), to set the measurement conditions and analyze the measurement data, the weight-average particle diameter (D4) and the number-average particle diameter (D1) of the toner (particle) are determined by carrying out measurements in 25,000 channels for the number of effective measurement channels and analyzing the measurement data.

The aqueous electrolyte solution used for the measurements is prepared by dissolving special-grade sodium chloride in deionized water to provide a concentration of approximately 1% by mass, and, for example, "ISOTON II" (from Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (from Beckman Coulter, Inc.). The threshold value and noise level are automatically set by pressing the threshold value/noise level measurement button. In addition, the current is set to 1600 μA.; the gain is set to 2; the aqueous electrolyte solution is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture flush" function of the dedicated software.

(2) Approximately 30 mL of the aforementioned aqueous electrolyte solution is introduced into a 100-mL flatbottom glass beaker. To this is added as dispersant approximately 0.3 mL of a dilution prepared by the three-fold (mass) dilution with deionized water of "Contaminon N" (a 10% by mass aqueous solution of a neutral pH 7 detergent for cleaning precision measurement instrumentation, comprising a nonionic surfactant, anionic surfactant, and organic builder, from Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and is equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner (particle) is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner (particle)-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) and the number-average particle diameter (D1) are calculated. When set to graph/volume % with the dedicated software, the "average diameter" on the analysis/volumetric statistical value (arithmetic average) screen is the weight-average particle diameter (D4). When set to graph/number % with the dedicated software, the "average diameter" on the "analysis/numerical statistical value (arithmetic average)" screen is the number-average particle diameter (D1).

<Measurement of the Molecular Weight and Composition Distribution of the Ester Wax>

The composition distribution of the ester wax is obtained by first measuring the molecular weight distribution by gel permeation chromatography (GPC) and then measuring this region by GC-MASS (gas chromatograph-mass spectroscopy) or MALDI TOF MASS (matrix-assisted laser desorption·ionization time-of-flight mass spectroscopy). The GPC of the ester wax is measured under the following conditions.

(GPC Measurement Conditions)

column: GMH-HT 30 cm×2 (Tosoh Corporation)

temperature: 135° C.

solvent: o-dichlorobenzene (addition of 0.1% IONOL)

flow rate: 1.0 mL/min sample: introduction of 0.4 mL of 0.15% sample

A molecular weight calibration curve constructed using monodisperse polystyrene standard samples is used for the determination of the sample molecular weight by measurement under the aforementioned conditions. In addition, calculation as polyethylene is carried out with a conversion equation derived from the Mark-Houwink viscosity equation.

The peaks obtained in this GPC are analyzed and the maximum value and minimum value of the molecular weight distribution of the ester wax are calculated. In the analysis by GC-MASS or MALDI TOF MASS as described below, the range bounded by the maximum value and minimum value obtained by this GPC is assumed to be the "range of the molecular weight distribution of the ester wax". The ester wax of the present invention can be measured by either the GC-MASS method or MALDI TOF MASS method; however, MALDI TOF MASS is selected as appropriate when volatilization is problematic and GC-MASS is selected as appropriate when there is peak overlap with the matrix. Both measurement methods are described in the following.

(GC-MASS Measurement Conditions)

The specific conditions for measurement of the composition distribution of the ester wax by GC-MASS will be described.

A GC-17A (Shimadzu Corporation) is used for the gas chromatography (GC).

10 mg of the sample is added to 1 mL of toluene and heated and dissolved for 20 minutes in an 80° C. thermostat. 1 μL of this solution is then injected into the GC instrument equipped with an on-column injector. A 0.5 mm diameter× 10 m length Ultra Alloy-1 (HT) (Frontier Laboratories Ltd.) is used for the column. The column is ramped up from the initial 40° C. to 200° C. at a ramp speed of 40° C./min; is further ramped up to 350° C. at 15° C./rain; and is then ramped up to 450° C. at a ramp speed of 7° C./min. For the carrier gas, He gas is fed under a pressure condition of 50 kPa.

The volatilized components here are introduced into the mass spectrometer (mass analyzer) and the peak group present in the aforementioned "range of the molecular weight distribution of the ester wax" is elucidated by obtaining the molecular weights of the plurality of peaks obtained by the GC. This peak group is analyzed and the sum total of the peak area is calculated. In addition, among the peaks obtained by GC, the peak having the largest peak area is taken to be the peak deriving from the ester compound having the largest content in the ester wax. The content (% by mass), with reference to the total amount of the ester wax, of the ester compound having the largest content is obtained by taking the ratio of the peak area for the ester compound having the largest content to the sum total for the total peak area.

Ester compound identification is carried out by separately injecting ester compounds with known structures and comparing those with the same outflow times, and/or by introducing the volatilized components into the mass spectrometer and performing spectral analysis.

The molecular weight M1 of the ester compound having the largest content in the ester wax can be determined by introducing the peak derived from the aforementioned ester compound having the largest content into the mass spectrometer and carrying out analysis.

In addition, 1.2×M1 (also referred to below as the M1+20% molecular weight) is calculated by multiplying the obtained M1 by 1.2, and 0.8×M1 (also referred to below as the M1-20% molecular weight) is calculated by multiplying by 0.8.

The plurality of peaks obtained in the spectrum yielded by GC is analyzed by the mass spectrometer, and the peaks present in the range from the M1−20% molecular weight to the M1+20% molecular weight (i.e., molecular weights M that satisfy $0.8\times M1\leq M\leq 1.2\times M1$) are identified and analyzed and the sum total of the peak area is calculated. Determining the ratio of this area value to the sum total of the peak area present in the "range of the molecular weight distribution of the ester wax" can provide the content (% by mass), based on the total amount of the ester wax, of the total ester compound having a molecular weight M that satisfies $0.8\times M1\leq M\leq 1.2\times M1$.

<MALDI TOF MASS Measurement Conditions>

Measurement of the composition distribution of the ester wax by MALDI TOF MASS will now be described. With regard to matrix selection, an optimal matrix was selected in accordance with the type of analyte with consideration given to avoiding overlap between the matrix peaks and analyte-derived peaks.

From among the peaks obtained by MALDI TOF MASS, the peaks present in the aforementioned "range of the molecular weight distribution of the ester wax" are elucidated and the sum total of the individual peak intensities is calculated.

From among these peaks, the peak with the maximum intensity is taken to be the peak deriving from the ester compound having the largest content in the ester wax. The content (% of mass), based on the total amount of the ester wax, of the ester compound having the largest content in the ester wax is calculated as the ratio, with respect to the sum total of the aforementioned peak intensities, of the peak intensity deriving from the ester compound having the largest content.

Ester compound identification can be carried out by analyzing the spectra obtained by MALDI TOF MASS for separate ester compounds with known structures.

The molecular weight M1 of the ester compound having the largest content in the ester wax is obtained by spectral analysis of the molecular weight of the peak derived from the aforementioned ester compound having the largest content. In addition, 1.2×M1 (also referred to below as the M1+20% molecular weight) is calculated by multiplying the obtained M1 by 1.2, and 0.8×M1 (also referred to below as the M1-20% molecular weight) is calculated by multiplying by 0.8.

The sum of the intensities of the peaks present in the range from the M1-20% molecular weight to the M1+20% molecular weight (i.e., molecular weights M that satisfy $0.8\times M1\leq M\leq 1.2\times M1$) is calculated. Determining the ratio of this sum of the intensities to the sum total of the peak intensities present in the "range of the molecular weight distribution of the ester wax" can provide the content (% by mass), based on the total amount of the ester wax, of the total ester compound having a molecular weight M that satisfies $0.8\times M1\leq M\leq 1.2\times M1$.

<Measurement of the Weight-average Molecular Weight (Mw) of the Crystalline Polyester>

The weight-average molecular weight (Mw) of the crystalline polyester is measured by gel permeation chromatography (GPC) as follows.

First, the crystalline polyester is dissolved in tetrahydrofuran (THF) at room temperature over at least 72 hours. The obtained solution is filtered across a "Sample Pretreatment Cartridge" solvent-resistant membrane filter with a pore diameter of 0.2 μm (from the Tosoh Corporation) to obtain the sample solution. The sample solution is adjusted to a THF-soluble component concentration of approximately 0.8% by mass. The measurement is performed under the following conditions using this sample solution.

instrument: "HLC-8220GPC" high-performance GPC instrument (from the Tosoh Corporation)
column: LF-604×2
eluent: THF
flow rate: 0.6 mL/minute
oven temperature: 40° C.
sample injection amount: 0.020 mL A calibration curve constructed using polystyrene resin standards (for example, product name: "TSK Standard Polystyrene F-850, F-450, F-288, F-128, F-80, F-40, F-20, F-10, F-4, F-2, F-1, A-5000, A-2500, A-1000, A-500", from the Tosoh Corporation) is used to determine the molecular weight of the sample.

<Measurement of the Acid Value of the Crystalline Polyester>

The acid value of the crystalline polyester is determined by the following procedure. The acid value is the number of milligrams of potassium hydroxide required to neutralize the acid present in 1 g of a sample. While the basic procedure for its measurement is according to JIS K 0070-1992, it is specifically measured according to the following protocol.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days, followed by filtration to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid is prepared in accordance with JIS K 8001-1998.

(2) Procedure (A) Main Test 2.0 g of the pulverized crystalline polyester is precisely weighed into a 200-mL Erlenmeyer flask and 100 mL of a toluene:ethanol (2:1) mixed solution is added and dissolution is carried out over 5 hours. Several drops of the aforementioned phenolphthalein solution are then added as an indicator and titration is performed using the aforementioned potassium hydroxide solution. The titration endpoint is taken to be persistence of the faint pink color of the indicator for 30 seconds.

(B) Blank Test

The same titration as in the above procedure is run, but without using the sample (that is, with only the toluene: ethanol (2:1) mixed solution).

(3) The obtained results are substituted into the following formula to calculate the acid value.

$$A=[(C-B)\times f\times 5.61]/S$$

Here, A: acid value (mg KOH/g), B: amount (mL) of addition of the potassium hydroxide solution in the blank test, C: amount (mL) of addition of the potassium hydroxide solution in the main test, f: the factor for the potassium hydroxide solution, and S: sample (g).

<Measurement of the Glass Transition Temperature (Tg) of the Toner Particle>

The glass transition temperature (Tg) of the toner particle is measured according to ASTM D 3418-82 using a "Q1000" (TA Instruments) differential scanning calorimeter.

The melting points of indium and zinc are used for temperature correction in the instrument detection section, and the heat of fusion of indium is used for correction of the amount of heat.

3.0 mg of the toner particles is precisely weighed out to give the measurement sample.

This is introduced into an aluminum pan, and, using an empty aluminum pan as the reference, measurement is carried out at normal temperature and normal humidity using a ramp rate of 10° C./min in the range from 30° C. to 200° C. for the measurement temperature range. During this ramp process, changes are obtained in the specific heat in the temperature range from 40° C. to 100° C.

The glass transition temperature (Tg) of the toner particle is taken to be the point at the intersection between the curve segment for the stepwise change at the glass transition and the straight line that is equidistant, in the direction of the vertical axis, from the straight lines formed by extending the baselines for prior to and subsequent to the appearance of the change in the specific heat in the curve for the specific heat change.

EXAMPLES

The present invention is more specifically described in the following using production examples and examples, but these in no way limit the present invention. Unless specifically indicated otherwise, the % and number of parts in the following mixtures are on a mass basis in all instances.

Production examples for the ester wax are described below. The ester wax was obtained in the present invention by producing ester compounds and melt mixing these in prescribed blending ratios.

<Ester Compound Production>

300 parts by mole of benzene, 200 parts by mole of docosanol (behenyl alcohol) as the alcohol monomer, and 100 parts by mole of decanedioic acid (sebacic acid) as the acid monomer were introduced into a reactor fitted with a Dimroth, a Dean-Stark water separator, and a thermometer. 10 parts by mole of p-toluenesulfonic acid was additionally added and thorough stirring was performed to effect dissolution; this was followed by heating under reflux for 6 hours; and subsequent to this the valve on the water separator was opened and azeotropic distillation was carried out. After the azeotropic distillation, thorough washing was performed with sodium bicarbonate followed by drying and removal of the benzene by distillation. The obtained product was recrystallized followed by washing and purification to obtain ester compound S-22.

Ester compounds were similarly obtained by changing the docosanol to other alcohols. S-20 was obtained by changing the docosanol to eicosanol; S-24 was obtained by changing to tetracosanol; S-16 was obtained by changing to 1-hexadecanol; and S-28 was obtained by changing to 1-octacosanol (montanyl alcohol).

In addition, the ester compounds described in Table 1-1 and Table 1-2 were obtained by changing the alcohol monomer and acid monomer as in Table 1-1 and Table 1-2.

TABLE 1-1

| | alcohol component | | acid component | |
|---|---|---|---|---|
| ester compound | name | number of carbons | name | number of carbons |
| S-20 | eicosanol | 20 | decanedioic acid (sebacic acid) | 10 |
| S-22 | docosanol (behenyl alcohol) | 22 | | |
| S-24 | tetracosanol | 24 | | |
| S-16 | 1-hexadecanol | 16 | | |
| S-28 | 1-octacosanol (montanyl alcohol) | 28 | | |
| N-20 | 1,9-nonanediol | 9 | eicosanoic acid (arachidic acid) | 20 |
| N-22 | | | docosanoic acid (behenic acid) | 22 |
| N-24 | | | tetracosanoic acid | 24 |
| H-20 | 1,6-hexanediol | 6 | eicosanoic acid (arachidic acid) | 20 |
| H-22 | | | docosanoic acid (behenic acid) | 22 |
| H-24 | | | tetracosanoic acid | 24 |
| DDO-20 | 1,12-dodecanediol | 12 | eicosanoic acid (arachidic acid) | 20 |
| DDO-22 | | 12 | docosanoic acid (behenic acid) | 22 |
| DDO-24 | | 12 | tetracosanoic acid | 24 |
| DDO-12 | | 12 | dodecanoic acid (lauric acid) | 12 |

TABLE 1-2

| ester compound | alcohol component name | alcohol component number of carbons | acid component name | acid component number of carbons |
|---|---|---|---|---|
| E-22 | ethylene glycol | 2 | docosanoic acid (behenic acid) | 22 |
| E-18 | | 2 | octadecanoic acid (stearic acid) | 18 |
| P-22 | pentaerythritol | 5 | docosanoic acid (behenic acid) | 22 |
| P-18 | | 5 | octadecanoic acid (stearic acid) | 18 |
| B-22 | docosanol (behenyl alcohol) | 22 | docosanoic acid (behenic acid) | 22 |
| B-18 | | 22 | octadecanoic acid (stearic acid) | 18 |
| B-16 | | 22 | hexadecanoic acid (palmitic acid) | 16 |
| ST-18 | 1-octadecanol (stearyl alcohol) | 18 | octadecanoic acid (stearic acid) | 18 |
| DD-20 | eicosanol | 20 | dodecanedioic acid | 12 |
| DD-22 | docosanol (behenyl alcohol) | 22 | | |
| DD-24 | tetracosanol | 24 | | |
| DD-12 | lauryl alcohol | 12 | | |

<Production of Ester Wax 1>

S-20, S-22, and S-24 were melt mixed in the mixing proportions (% by mass) given in Table 2-1 followed by cooling and then crushing to obtain ester wax 1.

The following, inter alia, are given in Table 2-1: the number of functional groups [designated with A* in the table] in the largest content ester compound in measurement of the obtained ester wax 1 by GC-MASS; the content (% by mass) for each ester compound [designated with B* in the table] in measurement of the obtained ester wax 1 by GC-MASS; the content (% by mass) of the largest content ester compound [designated by C* in the table] in measurement of the obtained ester wax 1 by GC-MASS; the total content (% by mass) of ester compounds having a molecular weight M satisfying $0.8\times M1 \leq M \leq 1.2\times M1$ [designated by D* in the table]; the melting point of the ester wax (° C.); and the presence/absence of a structure corresponding to formula (1) or (2) [designated by E* in the table]. The "content of formula (1) or (2)" gives the content ratio, relative to the ester wax, of ester compound having a partial structure given by formula (1) or a partial structure given by formula (2).

<Production of Ester Waxes 2 to 16>

Ester waxes 2 to 16 were obtained by melt mixing the ester compounds given in Table 2-1 and Table 2-2 in the indicated mixing proportions (% by mass), cooling, and then crushing. The formulations and properties of ester waxes 2 to 16 are given in Table 2-1 and Table 2-2.

<Production of Ester Wax 17>

An alcohol mixture of nonanol, decanol, and undecanol mixed in a mass ratio of 1:1:1 and a dicarboxylic acid mixture of nonanedioic acid, decanedioic acid, and undecanedioic acid mixed in a mass ratio of 1:1:1 were mixed in a mass ratio of 65:35 and this was introduced into a reaction kettle. Using magnesium sulfate as catalyst, heating and dehydration condensation were carried out. The reaction was completed at the point the acid value had fully declined. For ester wax 17, A* was 2; C* was 33%; D* was 98%; the melting point was 57.0° C.; E* was "present, formulas (1) and (2)"; x in formula (1) was 10; and y in formula (2) was 8.

TABLE 2-1

| ester wax No. | A* | ester compound | mixing proportions (% by mass) | ester compound content B* | C* | D* | melting point of the ester wax (° C.) | E* | x in formula (1) | y in formula (2) | content of formula (1) or (2) |
|---|---|---|---|---|---|---|---|---|---|---|---|
| 1 | 2 | S-20 | 15% | 15% | 70% | 100% | 73.0 | present, formula (2) | — | 8 | 100% |
| | | S-22 | 70% | 70% | | | | | | | |
| | | S-24 | 15% | 15% | | | | | | | |
| 2 | 2 | N-20 | 15% | 15% | 70% | 100% | 75.0 | present, formula (1) | 9 | — | 100% |
| | | N-22 | 70% | 70% | | | | | | | |
| | | N-24 | 15% | 15% | | | | | | | |
| 3 | 2 | H-20 | 30% | 30% | 40% | 100% | 71.0 | present, formula (1) | 6 | — | 100% |
| | | H-22 | 40% | 40% | | | | | | | |
| | | H-24 | 30% | 30% | | | | | | | |
| 4 | 2 | S-20 | 10% | 10% | 80% | 100% | 74.0 | present, formula (2) | — | 8 | 100% |
| | | S-22 | 80% | 80% | | | | | | | |
| | | S-24 | 10% | 10% | | | | | | | |
| 5 | 2 | DDO-20 | 10% | 10% | 70% | 90% | 70.0 | present, formula (1) | 12 | — | 100% |
| | | DDO-22 | 70% | 70% | | | | | | | |
| | | DDO-24 | 10% | 10% | | | | | | | |
| | | DDO-12 | 10% | 10% | | | | | | | |
| 6 | 2 | DD-20 | 10% | 10% | 70% | 90% | 76.0 | present, formula (2) | — | 10 | 100% |
| | | DD-22 | 70% | 70% | | | | | | | |
| | | DD-24 | 10% | 10% | | | | | | | |
| | | DD-12 | 10% | 10% | | | | | | | |
| 7 | 2 | S-20 | 5% | 5% | 70% | 80% | 72.5 | present, formula (2) | — | 8 | 100% |
| | | S-22 | 70% | 70% | | | | | | | |
| | | S-24 | 5% | 5% | | | | | | | |
| | | S-16 | 10% | 10% | | | | | | | |
| | | S-28 | 10% | 10% | | | | | | | |

TABLE 2-2

| ester wax No. | A* | ester compound | mixing proportions (% by mass) | ester compound content B* | C* | D* | melting point of the ester wax (° C.) | E* | x in formula (1) | y in formula (2) | content of formula (1) or (2) |
|---|---|---|---|---|---|---|---|---|---|---|---|
| 8 | 2 | S-20 | 15% | 15% | 50% | 80% | 72.0 | present, formula (2) | — | 8 | 100% |
| | | S-22 | 50% | 50% | | | | | | | |
| | | S-24 | 15% | 15% | | | | | | | |
| | | S-16 | 10% | 10% | | | | | | | |
| | | S-28 | 10% | 10% | | | | | | | |
| 9 | 2 | S-20 | 25% | 25% | 30% | 80% | 71.0 | present, formula (2) | — | 8 | 100% |
| | | S-22 | 30% | 30% | | | | | | | |
| | | S-24 | 25% | 25% | | | | | | | |
| | | S-16 | 10% | 10% | | | | | | | |
| | | S-28 | 10% | 10% | | | | | | | |
| 10 | 2 | S-22 | 85% | 85% | 85% | 85% | 75.0 | present, formula (2) | — | 8 | 100% |
| | | S-16 | 5% | 5% | | | | | | | |
| | | S-28 | 10% | 10% | | | | | | | |
| 11 | 2 | S-22 | 82% | 82% | 82% | 82% | 74.5 | present, formula (2) | — | 8 | 90% |
| | | S-16 | 5% | 5% | | | | | | | |
| | | S-28 | 3% | 3% | | | | | | | |
| | | B-22 | 10% | 10% | | | | | | | |
| 12 | 1 | B-22 | 100% | 100% | 100% | 100% | 74.0 | absent | — | — | 0% |
| 13 | 2 | S-20 | 12% | 12% | 56% | 80% | 73.0 | present, formula (2) | — | 8 | 80% |
| | | S-22 | 56% | 56% | | | | | | | |
| | | S-24 | 12% | 12% | | | | | | | |
| | | B-22 | 20% | 20% | | | | | | | |
| 14 | 2 | E-22 | 20% | 20% | 80% | 100% | 72.0 | absent | — | — | 0% |
| | | E-18 | 80% | 80% | | | | | | | |
| 15 | 4 | P-22 | 20% | 20% | 80% | 100% | 72.0 | absent | — | — | 0% |
| | | P-18 | 80% | 80% | | | | | | | |
| 16 | 1 | B-22 | 4% | 4% | 56% | 56% | 68.0 | absent | — | — | 0% |
| | | B-18 | 30% | 30% | | | | | | | |
| | | B-16 | 10% | 10% | | | | | | | |
| | | ST-18 | 56% | 56% | | | | | | | |

<Production of Crystalline Polyester 1>

230.0 parts of sebacic acid as the carboxylic acid monomer and 242.1 parts of 1,10-decanediol as the alcohol monomer were introduced into a reactor fitted with a nitrogen introduction line, a water separator, a stirrer, and a thermocouple.

The temperature was raised to 140° C. while stirring and a reaction was run for 8 hours at 140° C. under normal pressure and a nitrogen atmosphere while distilling out water. 1 part of tin dioctylate was then added per 100 parts of the total amount of the monomer followed by reaction while raising the temperature to 200° C. at 10° C./hour.

The reaction was run for two hours after reaching 200° C., followed by reducing the pressure within the reactor to 5 kPa or less and reacting for 3 hours at 200° C. to obtain crystalline polyester 1.

The weight-average molecular weight (Mw) of the obtained crystalline polyester 1 was 20,100 and its acid value was 2.2 mg KOH/g.

<Production of Crystalline Polyesters 2 to 14>

Crystalline polyesters 2 to 14 were obtained proceeding as in Production of Crystalline Polyester 1, but changing the alcohol monomer and carboxylic acid monomer as shown in Table 3-1 and adjusting the reaction time and temperature to provide the desired properties. The properties and structures of the obtained crystalline polyesters are shown in Tables 3-1 and 3-2.

TABLE 3-1

| crystalline polyester No. | alcohol monomer: monomer species | alcohol monomer: amount of addition (mass parts) | carboxylic acid monomer: monomer species | carboxylic acid monomer: amount of addition (mass parts) | weight-average molecular weight (Mw) | acid value (mg KOH/g) | melting point (° C.) |
|---|---|---|---|---|---|---|---|
| 1 | 1,10-decanediol | 242.1 | decanedioic acid (sebacic acid) | 230.0 | 20100 | 2.2 | 75.6 |
| 2 | 1,9-nonanediol | 202.4 | decanedioic acid (sebacic acid) | 255.5 | 10000 | 5.0 | 69.5 |
| 3 | 1,6-hexanediol | 155.2 | 1,10-decanedicarboxylic acid (dodecanedioic acid) | 279.3 | 30000 | 2.1 | 72.0 |
| 4 | 1,12-dodecanediol | 281.1 | hexanedioic acid (adipic acid) | 166.2 | 20000 | 3.1 | 71.2 |
| 5 | 1,10-decanediol<br>1,4-butanediol | 217.9<br>12.5 | decanedioic acid (sebacic acid) | 230.0 | 20100 | 3.2 | 74.9 |

TABLE 3-1-continued

| crystalline polyester No. | alcohol monomer: monomer species | alcohol monomer: amount of addition (mass parts) | carboxylic acid monomer: monomer species | carboxylic acid monomer: amount of addition (mass parts) | weight-average molecular weight (Mw) | acid value (mg KOH/g) | melting point (° C.) |
|---|---|---|---|---|---|---|---|
| 6 | 1,10-decanediol | 242.1 | decanedioic acid (sebacic acid) | 207.0 | 20100 | 3.1 | 74.8 |
| | | | hexanedioic acid (adipic acid) | 16.6 | | | |
| 7 | 1,6-hexanediol | 164.2 | decanedioic acid (sebacic acid) | 230.0 | 20100 | 2.1 | 67.5 |
| 8 | 1,12-dodecanediol | 281.1 | decanedioic acid (sebacic acid) | 230.0 | 20200 | 2.4 | 82.7 |
| 9 | 1,12-dodecanediol | 281.1 | 1,10-decanedicarboxylic acid (dodecanedioic acid) | 261.9 | 23000 | 2.3 | 90.4 |
| 10 | 1,6-hexanediol | 152.3 | hexanedioic acid (adipic acid) | 181.0 | 15000 | 7.2 | 65.0 |
| 11 | 1,12-dodecanediol | 245.3 | 1,10-decanedicarboxylic acid (dodecanedioic acid) | 302.6 | 40000 | 7.1 | 91.1 |
| 12 | 1,12-dodecanediol | 245.3 | butanedioic acid (succinic acid) | 155.2 | 39900 | 7.5 | 67.7 |
| 13 | diethylene glycol | 86.3 | decanedioic acid (sebacic acid) | 230.0 | 21000 | 2.2 | 65.1 |
| 14 | 1,4-butanediol | 125.2 | butanedioic acid (succinic acid) | 134.3 | 20100 | 3.5 | 64.0 |

TABLE 3-2

| crystalline polyester No. | structure of the crystalline polyester: presence/absence of a structure corresponding to formula (3) or (4) | x in formula (3) | y in formula (4) | x + y | content of formula (3) or (4) |
|---|---|---|---|---|---|
| 1 | present; formula (3) and formula (4) | 10 | 8 | 18 | 100% |
| 2 | present; formula (3) and formula (4) | 9 | 8 | 17 | 100% |
| 3 | present; formula (3) and formula (4) | 6 | 10 | 16 | 100% |
| 4 | present; formula (3) and formula (4) | 12 | 4 | 16 | 100% |
| 5 | present; formula (3) and formula (4) | 10 | 8 | 18 | 100% |
| 6 | present; formula (3) and formula (4) | 10 | 8 | 18 | 100% |
| 7 | present; formula (3) and formula (4) | 6 | 8 | 14 | 100% |
| 8 | present; formula (3) and formula (4) | 12 | 8 | 20 | 100% |
| 9 | present; formula (3) and formula (4) | 12 | 10 | 22 | 100% |
| 10 | present; formula (3) and formula (4) | 6 | 4 | 10 | 100% |
| 11 | present; formula (3) and formula (4) | 12 | 10 | 22 | 100% |
| 12 | present; formula (3) | 12 | 2 | 14 | 100% |
| 13 | present; formula (4) | 2 | 8 | 10 | 100% |
| 14 | absent | 4 | 2 | 6 | 0% |

In Tables 3-1 and 3-2, the "content of formula (3) or (4)" means the content in the crystalline polyester of the partial structure represented by formula (3) based on the total number of moles of partial structures derived from the diol component, or the content of the partial structure represented by formula (4) based on the total number of moles of partial structures derived from the dicarboxylic acid component.

Considering crystalline polyester 5, the content in the obtained crystalline polyester of the partial structure represented by formula (3) based on the total number of moles of partial structures derived from the diol component was 90 mol %. That is, it was equal to the value of {(number of moles of 1,10-decanediol added)/(number of moles of 1,10-decanediol added+number of moles of 1,4-butanediol added)}×100.

Considering crystalline polyester 6, the content in the obtained crystalline polyester, based on the total number of moles of partial structures derived from the dicarboxylic acid component, of the partial structure that, among the partial structures derived from the dicarboxylic acid component, is the partial structure with formula (4) having the largest content, was 90 mol %. That is, it was equal to the value of {(number of moles of sebacic acid added)/(number of moles of sebacic acid added+number of moles of adipic acid added)}×100.

<Magnetic Iron Oxide Production Example>

55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/min to obtain a slurry that contained core particles.

The obtained slurry was filtered and washed on a filter press, after which the core particles were reslurried by redispersion in water. To this reslurry liquid was added sodium silicate to provide 0.20% by mass as silicon per 100 parts of the core particles; the pH of the slurry was adjusted to 6.0; and a slurry of magnetic iron oxide particles having a silicon-rich surface was obtained by stirring.

The obtained slurry was filtered and washed with a filter press and was reslurried with deionized water. Into this reslurry liquid (solids fraction=50 g/L) was introduced 500 g (10% by mass relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide having a number-average diameter of 0.23 μm.

<Silane Compound Production>

30 parts of isobutyltrimethoxysilane was added dropwise to 70 parts of deionized water while stirring. While holding this aqueous solution at pH 5.5 and a temperature of 55° C., hydrolysis was then carried out by dispersing for 120 minutes using a dispersing impeller at a peripheral velocity of 0.46 m/s. This was followed by bringing the pH of the aqueous solution to 7.0 and cooling to 10° C. to stop the hydrolysis reaction. A silane compound-containing aqueous solution was obtained proceeding in this manner.

<Magnetic Body Production>

100 parts of the magnetic iron oxide was introduced into a high-speed mixer (Model LFS-2 from Fukae Powtec Corporation) and 8.0 parts of the silane compound-containing aqueous solution was added dropwise over 2 minutes while stirring at a rotation rate of 2,000 rpm. This was followed by mixing and stirring for 5 minutes. Then, in order to raise the adherence of the silane compound, drying was carried out for 1 hour at 40° C. and, after the moisture had been reduced, the mixture was dried for 3 hours at 110° C. to develop the condensation reaction of the silane compound. This was followed by crushing and passage through a screen having an aperture of 100 μm to obtain a magnetic body 1.

<Production of Toner Particle 1>

450 parts of a 0.1 mol/L aqueous $Na_3PO_4$ solution was introduced into 720 parts of deionized water and the temperature was raised to 60° C.; this was followed by the addition of 67.7 parts of a 1.0 mol/L aqueous $CaCl_2$ solution to obtain an aqueous medium containing a dispersion stabilizer.

| | |
|---|---|
| styrene | 79.0 parts |
| n-butyl acrylate | 21.0 parts |
| divinylbenzene | 0.6 parts |
| iron complex of a monoazo dye (T-77: Hodogaya Chemical Co., Ltd.) | 1.5 parts |
| magnetic body 1 | 95.0 parts |
| amorphous saturated polyester resin (amorphous saturated polyester resin obtained by a condensation reaction between terephthalic acid and the ethylene oxide and propylene oxide adduct of bisphenol A; Mw = 9,500, acid value = 2.2 mg KOH/g, glass transition temperature = 68° C.) | 5.0 parts |

This formulation was dispersed and mixed to uniformity using an attritor (Mitsui Miike Chemical Engineering Machinery Co.) to obtain a polymerizable monomer composition. This polymerizable monomer composition was heated to 63° C., and 9.0 parts of the crystalline polyester 1 indicated in Table 3-1 and 9.0 parts of the ester wax 1 indicated in Table 2-1 were added with mixing and dissolution.

This polymerizable monomer composition was introduced into the aforementioned aqueous medium and stirring was performed for 10 minutes at 12,000 rpm with a TK Homomixer (Tokushu Kika Kogyo Co., Ltd.) at 60° C. and under an $N_2$ atmosphere to effect granulation. Then, while stirring with a paddle stirring blade, 9.0 parts of the polymerization initiator t-butyl peroxypivalate was introduced and the temperature was raised to 70° C. and a reaction was run for 4 hours. After the completion of the reaction, the temperature of the suspension was raised to 100° C. and holding was carried out for 2 hours. After this, the suspension was cooled from 100° C. to 50° C. at a rate of 40° C./min in a cooling step by introducing ice into the suspension; this was followed by cooling to normal temperature while standing. Hydrochloric acid was then added to the suspension and the dispersion stabilizer was dissolved by thorough washing, and toner particle 1 was obtained by filtration and drying. The method of production and the formulation are given in Table 4. The glass transition temperature of toner particle 1 was 54° C.

<Production of Toner Particles 2 to 20, 22 to 26, 30, 32, and 33>

Toner particles 2 to 20, 22 to 26, 30, 32, and 33 were produced proceeding as in Production of Toner Particle 1, but changing the type and number of parts by mass of addition of the crystalline polyester, the type and number of parts by mass of addition of the ester wax, and the cooling step as indicated in Table 4.

The method of production and the formulation are shown in Table 4. The glass transition temperature of all the toner particles was in the 50 to 60° C. range.

<Production of Toner Particle 21>

| | |
|---|---|
| acrylic resin (VS-1057, Seiko PMC Corporation) | 100.0 parts |
| iron complex of a monoazo dye (T-77: Hodogaya Chemical Co., Ltd.) | 1.5 parts |
| magnetic iron oxide | 95.0 parts |
| ester wax 11 | 5.0 parts |
| crystalline polyester 12 | 5.0 parts |

These starting materials were preliminarily mixed with a Henschel mixer and were then kneaded using a twin-screw kneader/extruder set to 130° C. and 200 rpm. The obtained kneaded material was rapidly cooled to normal temperature, during which time the cooling rate was at least 20° C./second. After a coarse pulverization using a cutter mill, the obtained coarsely pulverized material was finely pulverized using a Turbomill T-250 (Turbo Kogyo Co., Ltd.) with the air temperature adjusted to provide an exhaust temperature of 50° C., followed by classification using a multi-grade classifier operating on the Coanda effect to obtain toner particle 21. The method of production and formulation are given in Table 4.

<Production of Toner Particle 27>

Toner particle 27 was produced proceeding as for the production of toner particle 22, but changing crystalline polyester 1 to crystalline polyester 13, changing ester wax 12 to a paraffin wax (HNP-9, Nippon Seiro Co., Ltd.), and changing the cooling rate from 5° C./min to 1° C./min. The production method and formulation are shown in Table 4. The glass transition temperature of toner particle 27 was 56° C.

<Production of Toner Particle 28>

Toner particle 28 was produced proceeding as for the production of toner particle 22, but changing ester wax 12 to carnauba wax (WA-03, Toa Kasei Co., Ltd.). The production method and formulation are shown in Table 4. The glass transition temperature of toner particle 28 was 57° C.

<Production of Toner Particle 29>

Toner particle 29 was produced proceeding as for the production of toner particle 22, but changing ester wax 12 to a microcrystalline wax (HiMic-1090, Nippon Seiro Co., Ltd.). The production method and formulation are given in Table 4. The glass transition temperature of toner particle 29 was 51° C.

<Production of Toner Particle 31>

Toner particle 31 was produced proceeding as for the production of toner particle 30, but using 1.8 parts for the amount of addition of crystalline polyester 14 and also adding 7.2 parts of crystalline polyester 1. The production method and formulation are given in Table 4. The glass transition temperature of toner particle 31 was 54° C.

<Production of Toner Particle 34>

Toner particle 34 was produced proceeding as for the production of toner particle 10, but changing ester wax 1 to ester wax 17. The glass transition temperature of toner particle 34 was 49° C.

<Production of Toners 1 to 21 and Comparative Toners 1 to 13>

Toner 1 was obtained by mixing the following using a Henschel mixer (Mitsui Miike Chemical Engineering Machinery Co., Ltd.): 100 parts of toner particle 1 and 0.8 parts of a hydrophobic silica fine powder provided by the hexamethyldisilazane treatment of dry silica fine particles having a BET value of 300 $m^2/g$ (primary particle number-average particle diameter=8 nm).

In addition, toners 2 to 21 and comparative toners 1 to 13 were obtained proceeding in the same manner, but using toner particles 2 to 34 for toner particle 1. The production methods and formulations are given in Table 4. All of these toners had a weight-average particle diameter (D4) of from 6.0 to 9.0 μm.

TABLE 4

| | | crystalline polyester | | ester wax | | | toner production method | |
|---|---|---|---|---|---|---|---|---|
| toner | toner particle No. | crystalline polyester No. | amount of addition (parts by mass) | ester wax No. or type | amount of addition (parts by mass) | ester wax/ crystalline polyester mass ratio | production method | cooling rate (° C./min) |
| toner 1 | 1 | 1 | 9.0 | 1 | 9.0 | 50/50 | suspension polymerization | 40 |
| toner 2 | 2 | 2 | 9.0 | 2 | 9.0 | 50/50 | suspension polymerization | 40 |
| toner 3 | 3 | 3 | 9.0 | 3 | 9.0 | 50/50 | suspension polymerization | 40 |
| toner 4 | 4 | 4 | 9.0 | 4 | 9.0 | 50/50 | suspension polymerization | 40 |
| toner 5 | 5 | 1 | 9.0 | 1 | 9.0 | 50/50 | suspension polymerization | 40 |
| toner 6 | 6 | 1 | 20.0 | 1 | 6.7 | 25/75 | suspension polymerization | 40 |
| toner 7 | 7 | 1 | 3.0 | 1 | 9.0 | 75/25 | suspension polymerization | 40 |
| toner 8 | 8 | 5 | 9.0 | 1 | 9.0 | 50/50 | suspension polymerization | 40 |
| toner 9 | 9 | 6 | 9.0 | 1 | 9.0 | 50/50 | suspension polymerization | 40 |
| toner 10 | 10 | 7 | 9.0 | 1 | 9.0 | 50/50 | suspension polymerization | 40 |
| toner 11 | 11 | 8 | 9.0 | 5 | 9.0 | 50/50 | suspension polymerization | 40 |
| toner 12 | 12 | 8 | 9.0 | 6 | 9.0 | 50/50 | suspension polymerization | 5 |
| toner 13 | 13 | 1 | 9.0 | 7 | 9.0 | 50/50 | suspension polymerization | 40 |
| toner 14 | 14 | 1 | 9.0 | 8 | 9.0 | 50/50 | suspension polymerization | 40 |
| toner 15 | 15 | 1 | 9.0 | 9 | 9.0 | 50/50 | suspension polymerization | 40 |
| toner 16 | 16 | 9 | 9.0 | 10 | 9.0 | 50/50 | suspension polymerization | 40 |
| toner 17 | 17 | 10 | 9.0 | 10 | 9.0 | 50/50 | suspension polymerization | 40 |
| toner 18 | 18 | 9 | 9.0 | 11 | 9.0 | 50/50 | suspension polymerization | 40 |
| toner 19 | 19 | 11 | 9.0 | 11 | 9.0 | 50/50 | suspension polymerization | 40 |
| toner 20 | 20 | 12 | 9.0 | 11 | 9.0 | 50/50 | suspension polymerization | 40 |
| toner 21 | 21 | 12 | 5.0 | 11 | 5.0 | 50/50 | kneading and pulverization | — |
| comparative toner 1 | 22 | 1 | 9.0 | 12 | 9.0 | 50/50 | suspension polymerization | 5 |
| comparative toner 2 | 23 | 1 | 9.0 | 13 | 9.0 | 50/50 | suspension polymerization | 5 |
| comparative toner 3 | 24 | 1 | 9.0 | 14 | 9.0 | 50/50 | suspension polymerization | 5 |
| comparative toner 4 | 25 | 1 | 9.0 | 15 | 9.0 | 50/50 | suspension polymerization | 5 |
| comparative toner 5 | 26 | 1 | 9.0 | 16 | 9.0 | 50/50 | suspension polymerization | 5 |
| comparative toner 6 | 27 | 13 | 9.0 | HNP-9 (paraffin wax) | 9.0 | — | suspension polymerization | 1 |
| comparative toner 7 | 28 | 1 | 9.0 | WA-03 (carnauba wax) | 9.0 | 50/50 | suspension polymerization | 5 |
| comparative toner 8 | 29 | 1 | 9.0 | HiMic-1090 (microcrystalline wax) | 9.0 | — | suspension polymerization | 5 |
| comparative toner 9 | 30 | 14 | 9.0 | 1 | 9.0 | 50/50 | suspension polymerization | 5 |
| comparative toner 10 | 31 | 1<br>14 | 7.2<br>1.8 | 1 | 9.0 | 50/50 | suspension polymerization<br>suspension polymerization | 5 |
| comparative toner 11 | 32 | 1 | 1.0 | 1 | 1.0 | 50/50 | suspension polymerization | 5 |
| comparative toner 12 | 33 | 1 | 27.0 | 1 | 3.0 | 10/90 | suspension polymerization | 1 |
| comparative toner 13 | 34 | 7 | 9.0 | 17 | 9.0 | 50/50 | suspension polymerization | 40 |

Example 1

(Initial Developing Performance)

Using toner 1 and using an LBP3410 (monochrome laser printer from Canon, Inc.) as the image-forming apparatus, standing was carried out for 1 day in a normal-temperature, normal-humidity environment (23° C./60% RH). An A4 paper for color laser copying (Canon, Inc., 80 $g/m^2$) was used as the paper type. Five prints of a solid image were continuously output in the normal-temperature, normal-humidity environment, and the printed image density on the obtained five solid image prints was measured using a MacBeth reflection densitometer (MacBeth Corporation). The evaluation was carried out by designating the lowest value thereamong as the solid density, wherein a higher solid density was taken to be a better developing performance. The results of the evaluation are given in Table 5.

(Fixing Performance)

The following evaluation was performed using toner 1.

FOX RIVER BOND paper (110 g/m$^2$) was used as the fixing media. The use of a heavy paper having a relatively large surface unevenness provides rigorousness with regard to the rubbing of the printed image. In addition, the toner becomes thoroughly chilled by standing in a low-temperature environment, which creates more rigorous conditions with regarding to fixation. The image-forming apparatus used in the evaluation of the developing performance was modified to enable adjustment of the developing bias and this was used as the image-forming apparatus here.

The evaluation procedure is given in the following. First, the image-forming apparatus was held overnight in a low-temperature, low-humidity environment (15° C./10% RH). After this, the developing bias was adjusted to provide an image density (measured using a MacBeth reflection densitometer (MacBeth Corporation)) of from 1.40 to 1.45 when the solid image was printed using the FOX RIVER BOND paper. After standing for an additional one hour in the low-temperature, low-humidity environment, five prints of a solid image were output at the adjusted bias setting, and the five solid image prints were then rubbed twice with one sheet of lens-cleaning paper with a load of 55 g/cm$^2$ placed on the lens-cleaning paper. The appearance was evaluated as follows using the solid image post-rubbing and the lens-cleaning paper used for the rubbing.

A: uniformity of the image density is maintained even after rubbing

B: uniformity of the image density is maintained even after rubbing, but the lens-cleaning paper is very slightly stained C: uniformity of the image density is maintained even after rubbing, but the lens-cleaning paper is clearly stained D: an area is present in the post-rubbing solid image in which the density is attenuated to a degree that can be detected upon holding up to light (nonuniform area)

E: an area is seen in the post-rubbing solid image in which the density is clearly attenuated (Low-Temperature Durability [Development Streaks])

To carry out the evaluation, a sleeve with a diameter of 10 mm was installed as the developing sleeve in the LBP-3410 used as the image-forming apparatus in the evaluation of the initial developing performance; the length of the developing sleeve was also adjusted; and a cartridge was used that had been modified such that the toner was laid on the developing sleeve at 0.4 to 0.6 mg/cm$^2$. These conditions are conditions that provide a small developing sleeve and that also reduce the amount of toner laid on the developing sleeve to about half of normal. The development streaks caused by toner melt adhesion to the developing sleeve are evaluated here. The indicated modifications all serve to raise the pressure between the toner and the developing sleeve in the evaluation of the development durability, thereby facilitating the induction of melt adhesion to the developing sleeve. Moreover, in a low-temperature environment, the toner becomes brittle due to low-temperature embrittlement, and the occurrence of melt adhesion to the developing sleeve is then also facilitated by the production of partial cracking and chipping. A rigorous evaluation of development streaks can be performed through the combination of these conditions.

Toner 1 was evaluated using this image-forming apparatus. For the evaluation procedure, the image-forming apparatus was held overnight in a very low-temperature, low-humidity environment (7.5° C., 10% RH), which is an even lower temperature than for the environment during the evaluation of the fixing performance. After this, 15,000 prints of a horizontal line image with a print percentage of 1% were output in this environment in intermittent mode. To evaluate the development streaks, after the durability test the following were jointly scored according to the criteria given below: the results of visual checking of the status of melt adhesion on the developing sleeve after the toner on the developing sleeve had been removed with an air blower, and the results of visual observation of the image after the output of a halftone image.

A: streaks are not present on the developing sleeve and streaks are also not observed in the image B: slight streaks are observed on the developing sleeve, but are not seen in the image C: slight streaks are observed in large numbers on the developing sleeve, but are not seen in the image D: Distinct streaks are observed on the developing sleeve. Slight streaks are also produced in the halftone image.

Examples 2 to 21

The same image output tests were carried out as in Example 1, but using toners 2 to 21 in place of toner 1. The results for all of these toners were as follows: no problems with the initial developing performance, a rank of D or better in the fixing performance, and a rank of C or better in the low-temperature durability. The results of the evaluations are given in Table 5.

Comparative Examples 1 to 12

The same image output tests were carried out as in Example 1, but using comparative toners 1 to 12 in place of toner 1. The results for all of these toners were an evaluation of E for the fixing performance and/or an evaluation of D for the low-temperature durability. The results of the evaluations are given in Table 5.

Comparative Example 13

The evaluation was D when the low-temperature durability test was run by changing toner 1 in Example 1 to comparative toner 13. The other evaluations were not carried out.

TABLE 5

| | toner | initial developing performance | fixing performance | low-temperature durability |
|---|---|---|---|---|
| Example 1 | toner 1 | 1.52 | A | A |
| Example 2 | toner 2 | 1.51 | A | A |
| Example 3 | toner 3 | 1.51 | A | B |
| Example 4 | toner 4 | 1.50 | A | A |
| Example 5 | toner 5 | 1.50 | A | A |
| Example 6 | toner 6 | 1.50 | A | A |
| Example 7 | toner 7 | 1.50 | A | A |
| Example 8 | toner 8 | 1.50 | A | A |
| Example 9 | toner 9 | 1.50 | A | A |
| Example 10 | toner 10 | 1.50 | A | A |
| Example 11 | toner 11 | 1.50 | A | B |

TABLE 5-continued

| | toner | initial developing performance | fixing performance | low-temperature durability |
|---|---|---|---|---|
| Example 12 | toner 12 | 1.50 | A | B |
| Example 13 | toner 13 | 1.50 | B | A |
| Example 14 | toner 14 | 1.50 | B | B |
| Example 15 | toner 15 | 1.50 | B | C |
| Example 16 | toner 16 | 1.45 | C | C |
| Example 17 | toner 17 | 1.46 | C | C |
| Example 18 | toner 18 | 1.42 | C | C |
| Example 19 | toner 19 | 1.42 | D | C |
| Example 20 | toner 20 | 1.38 | D | C |
| Example 21 | toner 21 | 1.35 | D | C |
| Comparative Example 1 | comparative toner 1 | 1.50 | B | D |
| Comparative Example 2 | comparative toner 2 | 1.50 | B | D |
| Comparative Example 3 | comparative toner 3 | 1.50 | E | D |
| Comparative Example 4 | comparative toner 4 | 1.50 | E | D |
| Comparative Example 5 | comparative toner 5 | 1.50 | E | D |
| Comparative Example 6 | comparative toner 6 | 1.35 | B | D |
| Comparative Example 7 | comparative toner 7 | 1.50 | E | D |
| Comparative Example 8 | comparative toner 8 | 1.50 | E | D |
| Comparative Example 9 | comparative toner 9 | 1.50 | C | D |
| Comparative Example 10 | comparative toner 10 | 1.50 | C | D |
| Comparative Example 11 | comparative toner 11 | 1.50 | E | C |
| Comparative Example 12 | comparative toner 12 | 1.35 | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-046250, filed Mar. 9, 2015, which is hereby incorporated by reference herein in its entirety.

What is claimed is:

1. A toner comprising a toner particle, said toner particle comprising:

a binder resin;

a colorant;

a release agent comprising an ester wax having a peak top temperature of a maximum endothermic peak of 65 to 85° C. measured with a differential scanning calorimeter, the ester wax comprising ester compounds each having two ester bonds in the individual molecule, the ester compounds each having one partial structure represented by formula (1-1) and two partial structures each represented by formula (2-2)

$$-O-C_xH_{2x}-O- \quad (1\text{-}1)$$

$$C_yH_{2y+1}-\overset{\overset{\displaystyle O}{\|}}{C}- \quad (2\text{-}2)$$

where x represents an integer from 6 to 12 and y represents an integer from 4 to 10, or two partial structures each represented by formula (1-2) and one partial structure represented by formula (2-1)

$$C_xH_{2x+1}-O- \quad (1\text{-}2)$$

$$-\overset{\overset{\displaystyle O}{\|}}{C}-C_yH_{2y}-\overset{\overset{\displaystyle O}{\|}}{C}- \quad (2\text{-}1)$$

where x represents an integer from 6 to 12 and y represents an integer from 4 to 10, the content of the ester compounds being at least 90% by mass based on a total mass of the ester wax, with ester compound S-22 prepared from docosanol and decanedioic acid, or ester compound N-22 prepared from 1,9-nonanediol and docosanoic acid having a largest content of any of the ester compounds contained in the ester wax, said largest content being from 70 to 80% by mass based on a total mass of the ester wax in a composition distribution measured by GC-MASS or MALDI TOF MASS, and the toner particle further comprising a crystalline polyester that satisfies condition (iii) or (iv)

(iii) the crystalline polyester has a partial structure represented by formula (3), and the content of the partial structure represented by formula (3) is at least 90 mol % based on a total number of moles of a partial structure derived from a diol component in the crystalline polyester $$-O-C_xH_{2x}-O- \quad (3)$$

where x represents an integer from 6 to 12, or (iv) the crystalline polyester has a partial structure represented by formula (4), and the content of the partial structure represented by formula (4) is at least 90 mol % based on a total number of moles of a partial structure derived from a dicarboxylic acid component in the crystalline polyester $$-\overset{\overset{\displaystyle O}{\|}}{C}-C_yH_{2y}-\overset{\overset{\displaystyle O}{\|}}{C}- \quad (4)$$

where y represents an integer from 4 to 10, wherein the toner contains 3.0 to 20.0 parts by mass of the crystalline polyester per 100 parts by mass of the binder resin, and a mass ratio of the ester wax to crystalline polyester (ester wax/crystalline polyester) is from 25/75 to 75/25.

2. The toner according to claim 1, wherein the binder resin comprises a styrene-acrylic acid copolymer as a main component.

3. The toner according to claim 1, wherein the total content of ester compounds having a molecular weight M that satisfies $0.8\times M1 \leq M \leq 1.2\times M1$ is at least 90% by mass based on a total amount of the ester wax, where M1 is the molecular weight of the ester compound having the largest content in the ester wax.

4. The toner according to claim 1, wherein an acid value of the crystalline polyester is not more than 8.0 mg KOH/g.

5. The toner according to claim 1, wherein the acid value of the crystalline polyester is not more than 5.0 mg KOH/g.

6. The toner according to claim 1, wherein the acid value of the crystalline polyester is not more than 3.5 mg KOH/g.

7. The toner according to claim 1, wherein ester compound S-22 has the largest content of any of the ester compounds contained in the ester wax.

8. The toner according to claim 1, wherein ester compound N-22 has the largest content of any of the ester compounds contained in the ester wax.

* * * * *